US012529221B2

(12) United States Patent
Bogh

(10) Patent No.: US 12,529,221 B2
(45) Date of Patent: Jan. 20, 2026

(54) DOVETAIL DECKING SYSTEM WITH A FULL TOP FLANGE SIDELAP AND METHOD OF SECURING

(71) Applicant: Verco Decking, Inc., Phoenix, AZ (US)

(72) Inventor: Brian Hansen Bogh, Yucaipa, CA (US)

(73) Assignee: Verco Decking, Inc., Phoenix, AZ (US)

( * ) Notice: Subject to any disclaimer, the term of this patent is extended or adjusted under 35 U.S.C. 154(b) by 188 days.

(21) Appl. No.: 18/138,782

(22) Filed: Apr. 25, 2023

(65) Prior Publication Data

US 2023/0349144 A1 Nov. 2, 2023

Related U.S. Application Data

(60) Provisional application No. 63/336,096, filed on Apr. 28, 2022.

(51) Int. Cl.
*E04B 1/00* (2006.01)
*E04B 1/16* (2006.01)
(Continued)

(52) U.S. Cl.
CPC ..... *E04B 1/003* (2013.01); *E04B 1/167* (2013.01); *E04C 2/08* (2013.01); *E04C 2/322* (2013.01);
(Continued)

(58) Field of Classification Search
CPC .... E04B 1/003; E04B 1/167; E04B 2001/199; E04B 2001/2418; E04C 2/08; E04C 2/322; E04C 2/526; E04C 2002/001
See application file for complete search history.

(56) References Cited

U.S. PATENT DOCUMENTS 502,552 A 8/1893 Detombay
1,156,866 A 10/1915 Ford
(Continued)

FOREIGN PATENT DOCUMENTS

EP 1099033 A1 5/2001
EP 1767712 A1 3/2007
(Continued)

OTHER PUBLICATIONS

English Translation of TW M580100 (Year: 2019).*
(Continued)

*Primary Examiner* — Andrew J Triggs
(74) *Attorney, Agent, or Firm* — Moore & Van Allen PLLC; Jeffrey R. Gray

(57) ABSTRACT

Structural dovetail decking panel systems that utilize dovetail decking panels with a proximal edge having a proximal arm extending outwardly away from the dovetail decking panel, and a distal edge having a distal arm extending inwardly towards the dovetail decking panel. When adjacent dovetail decking panels are joined, the proximal edge having the proximal arm of a panel is placed over the distal end having the distal arm of the adjacent panel to create a dovetail sidelap. The proximal arm and/or the distal arm aid in restricting movement of the proximal edge and the distal edge of adjacent panels in order control the dimensions of a sidelap cavity and opening in the dovetail sidelap, which improves the strength of the dovetail decking panel systems, allows for the reduction of the thickness of the panels or number of couplings used, and/or allows for anchors to be utilized within the sidelap cavity.

17 Claims, 25 Drawing Sheets

(51) Int. Cl.

| | |
|---|---|
| ***E04B 1/19*** | (2006.01) |
| ***E04B 1/24*** | (2006.01) |
| ***E04C 2/00*** | (2006.01) |
| ***E04C 2/08*** | (2006.01) |
| ***E04C 2/32*** | (2006.01) |
| ***E04C 2/52*** | (2006.01) |

(52) U.S. Cl.
CPC ..... *E04C 2/526* (2013.01); *E04B 2001/199* (2013.01); *E04B 2001/2418* (2013.01); *E04C 2002/001* (2013.01)

(56) References Cited

U.S. PATENT DOCUMENTS

| | | | |
|---|---|---|---|
| D165,978 | S | 2/1952 | Haman et al. |
| 3,094,745 | A | 6/1963 | Stout |
| 3,150,465 | A | 9/1964 | Johnson |
| 3,421,279 | A | 1/1969 | Franc |
| 3,466,831 | A | 9/1969 | Lenoir |
| D216,836 | S | 3/1970 | Faulkner et al. |
| 3,520,100 | A | 7/1970 | Webb |
| 3,524,292 | A | 8/1970 | Bottom |
| 3,667,185 | A | 6/1972 | Maurer |
| 3,674,620 | A | 7/1972 | Mccarthy et al. |
| 3,760,549 | A | 9/1973 | Silberkuhl et al. |
| 3,884,328 | A | 5/1975 | Williams |
| D238,898 | S | 2/1976 | Landis |
| 4,271,653 | A | 6/1981 | Buchhorn |
| 5,165,213 | A | 11/1992 | Finch et al. |
| D337,169 | S | 7/1993 | Schipp |
| 5,259,157 | A | 11/1993 | Ault |
| 5,566,522 | A | 10/1996 | Casper et al. |
| D380,281 | S | 6/1997 | Menz |
| D441,876 | S | 5/2001 | Eaton |
| D443,368 | S | 6/2001 | Eaton |
| D511,580 | S | 11/2005 | Ryan et al. |
| 7,328,667 | B1 | 2/2008 | Ryan et al. |
| D622,417 | S | 8/2010 | Ryan |
| D623,773 | S | 9/2010 | Ryan |
| D648,445 | S | 11/2011 | Ryan |
| D655,022 | S | 2/2012 | Ryan |
| D663,045 | S | 7/2012 | Ryan |
| 8,240,095 | B1 | 8/2012 | Meyer |
| 8,505,259 | B1 | 8/2013 | Degtyarev |
| 8,572,900 | B1 | 11/2013 | Potts |
| D710,038 | S | 7/2014 | Keen |
| D713,554 | S | 9/2014 | Ryan |
| 8,881,469 | B1 | 11/2014 | Meyer |
| D735,355 | S | 7/2015 | Bodwell et al. |
| 9,273,870 | B2 | 3/2016 | Sulzer et al. |
| 10,316,519 | B2 | 6/2019 | Bogh et al. |
| 10,370,851 | B2 * | 8/2019 | Bodwell ..... E04C 2/08 |
| D915,628 | S | 4/2021 | Place et al. |
| D927,022 | S | 8/2021 | Klees et al. |
| D949,441 | S | 4/2022 | Ryan |
| D949,442 | S | 4/2022 | Ryan |
| D950,108 | S | 4/2022 | Ryan |
| D1,016,339 | S | 2/2024 | Curtin et al. |
| D1,018,907 | S | 3/2024 | Lee et al. |
| D1,032,309 | S | 6/2024 | O'Malley |
| 2004/0187416 | A1 | 9/2004 | Grossman et al. |
| 2015/0068133 | A1 | 3/2015 | Den Adel |
| 2015/0308116 | A1 | 10/2015 | Bogh et al. |
| 2016/0333584 | A1 | 11/2016 | Bogh et al. |
| 2017/0268233 | A1 | 9/2017 | Bodwell et al. |
| 2019/0195251 | A1 | 6/2019 | Bodwell et al. |
| 2020/0354972 | A1 | 11/2020 | Bogh et al. |
| 2023/0349144 | A1 * | 11/2023 | Bogh ..... E04C 2/322 |

FOREIGN PATENT DOCUMENTS

| | | | |
|---|---|---|---|
| GB | 2456422 | B | 5/2012 |
| GB | 2456423 | B | 6/2012 |
| GB | 2458743 | B | 9/2012 |
| JP | 2023101161 | A | 7/2023 |
| TW | M580100 | U | 7/2019 |
| WO | 2004061249 | A1 | 7/2004 |

OTHER PUBLICATIONS

Verco Decking Company Website, available since at least Jul. 23, 2020, online. Site visited on Aug. 7, 2024. URL: <"https:// web.archive.org/web/20200723152737/https://vercodeck.com/"> (Year: 2020).

* cited by examiner

DOVETAIL DECKING SYSTEM WITH A FULL TOP FLANGE SIDELAP AND METHOD OF SECURING

PRIORITY CLAIM UNDER 35 U.S.C. § 119

This application claims priority to U.S. Provisional Application No. 63/336,096 entitled "Dovetail Decking System with a Full Top Flange Sidelap and Method of Securing" filed on Apr. 28, 2022, which is assigned to the assignee hereof and the entirety of which is incorporated by reference herein.

FIELD

This application relates generally to the field of structural panel systems and more particularly to improvements to structural dovetail panels.

BACKGROUND

Structural panels are used in commercial, industrial, and residential construction), for example, as a component of poured concrete floors or as structural roofing (e.g., for commercial buildings, industrial buildings, institutional buildings, or the like). Structural panels are typically manufactured from steel sheets, which may or may not be coiled. In order to increase the structural strength and the stiffness of the individual steel sheets, structural panels having flutes with longitudinal profiles are formed from the steel sheets via roll forming, break forming, bending, stamping, or other like processes. The structural panels are secured to each other in order to form the structural steel panel system when installed. These structural panels may be used as roof decking, floor decking, or wall panels. As such, fluted structural panels may be used in a variety of building applications.

The panels are also connected to the other load resisting structural members of a building, such as steel beams, joists, walls, other structural elements, or the like. When the panels are connected to each other in a secure manner for use in roof or floor applications, the assembled structural steel decking system provides considerable diaphragm (or membrane) strength, which is used to transfer horizontal loads to the vertical and lateral load carrying components of the building. When the structural panels are used in wall systems, the structural wall panels are used to transfer vertical and lateral loads to the horizontal load carrying components.

In geographic regions that are prone to seismic activity (e.g., earthquakes) and/or high winds, the structural panels are solidly connected to each other and to the other load resisting structural members of the building so that the building is better able to withstand shear forces (e.g., horizontal shear forces and vertical shear forces) created by the seismic activity and/or high winds. The structural panels are connected to reduce, or eliminate excessive, out-of-plane separation (e.g., vertical separation between the sheets in the case of structural decking panels, or horizontal separation between the sheets in the case of structural wall panels; stated otherwise as out-of-plane movement in which the edges of the sheets move apart from each other) or in-plane movement (e.g., horizontal movement between the sheets in the case of structural decking panels or vertical movement between the sheets in the case of structural wall panels; stated otherwise as in-plane movement in which the sheets slip along the length of the edges). To this end, the sidelap between adjacent structural panels is joined in such a way as to create resistance in a direction parallel to the lengthwise extending axis of the sidelap to thereby carry loads (e.g., resist forces) and prevent displacement between the structural panels. In addition, the connection of the panels at the sidelap also creates out-of-plane resistance along the sidelap (e.g., vertical resistance to one panel lifting off of an adjacent panel) in order to carry loads (e.g., construction loads) and to maintain the structural integrity of the diaphragm strength of the system.

BRIEF SUMMARY

Structural dovetail decking panels (otherwise described as dovetail decking panels, decking panels, dovetail decking, dovetail panels, keystone decking panels, re-entrant decking panels, or the like) may be provided with two edges, that is, a proximal edge and a distal edge. The proximal edge may have a proximal top flange and a proximal arm extending from the proximal top flange outwardly away from the dovetail decking panel. The distal edge may have a distal top flange and a distal arm extending inwardly towards the dovetail decking panel. When adjacent dovetail decking panels are joined, the proximal edge having the proximal arm of a panel is placed over the distal edge having the distal arm of the adjacent panel to create a dovetail sidelap. The proximal top flange, the proximal arm, the distal top flange, and/or the distal arm aid in restricting movement of the proximal edge and the distal edge of adjacent panels in order control the dimensions of a sidelap cavity and opening in the dovetail sidelap. The dovetail sidelap that utilizes the proximal arm and/or the distal arm improves the strength of the dovetail decking panel systems, allows for the reduction of the thickness of the panels and/or the number of couplings used due to the improved strength, and/or allows for anchors to be utilized within the sidelap cavity due to improved control of the dimensions of the sidelap.

One embodiment of the present disclosure is a structural dovetail panel system comprising a first structural dovetail panel, a second structural dovetail panel, and one or more couplings formed in the dovetail sidelap for operatively coupling the first structural dovetail panel to the second structural dovetail panel. The first structural dovetail panel comprises a plurality of first dovetail flutes wherein each of the plurality of first dovetail flutes comprise a first top flange, portions of two first bottom flanges, and two first webs operatively coupling the first top flange to the portions of the two first bottom flanges, wherein the two first webs converge from the first top flange towards the portions of the two first bottom flanges to form a first flute cavity with a first flute opening, and a first distal edge comprising a first distal top flange. The second structural dovetail panel comprises a plurality of second dovetail flutes, wherein each of the plurality of second dovetail flutes comprise a second top flange, portions of two second bottom flanges, and two second webs operatively coupling the second top flange to the portions of the two second bottom flanges, wherein the two second webs converge from the second top flange towards the portions of the two second bottom flanges to form a second flute cavity with a second flute opening, and a second proximal edge comprising a second proximal top flange and a second proximal arm extending outwardly away from the second structural dovetail panel. The second proximal top flange and the second proximal arm are located over the first distal top flange to create the dovetail sidelap and the sidelap cavity with the sidelap opening.

In further accord with embodiments, the second proximal top flange is operatively coupled to a second bottom flange through a second proximal web. The second proximal arm extends outwardly away from the second structural dovetail panel at a second proximal arm angle that is less than or equal to a second proximal web angle of the second proximal web with respect to a second proximal top flange plane.

In other embodiments, a first distal arm extends inwardly towards the first structural dovetail panel from the first distal edge, and wherein the second proximal top flange and the second proximal arm are located over the first distal top flange and the first distal arm.

In still other embodiments, the second proximal top flange is operatively coupled to a second bottom flange through a second proximal web. The first distal arm extends inwardly toward the first structural dovetail panel at a first distal arm angle that is less than or equal to a second proximal web angle of the second proximal web with respect to a second proximal top flange plane.

In yet other embodiments, the proximal top flange and the first distal top flange are restricted from moving horizontally with respect to each other by the second proximal arm and the first distal arm.

In other embodiments, the first distal arm has a first distal arm length that is less than half of the length of the second proximal web.

In further accord with embodiments, the second proximal arm has a second proximal arm length that is less than half of the length of the second proximal web.

In other embodiments, the structural dovetail panel system further comprises one or more dovetail anchors located within the sidelap cavity.

In still other embodiments, the one or more couplings comprise fasteners that extend through the second proximal top flange and the first distal top flange.

In yet other embodiments, the structural dovetail panel system further comprises a third structural dovetail panel comprising a plurality of third dovetail flutes, wherein each of the plurality of third dovetail flutes comprise a third top flange, portions of two third bottom flanges, and two third webs operatively coupling the third top flange to the portions of the two third bottom flanges, wherein the two third webs converge from the third top flange towards the portions of the two third bottom flanges to form a third flute cavity with a third flute opening. The two third bottom flanges of the third dovetail flutes comprise two third ribs. The two second bottom flanges of the second dovetail flutes comprise two second ribs. The two first bottom flanges of the first dovetail flutes comprise two first ribs. The third structural dovetail panel is in series with the first structural dovetail panel and the second structural dovetail panel and the plurality of third dovetail flutes are offset with the first dovetail flutes and the second dovetail flutes such that the two third ribs are offset with the two second ribs and the two third ribs.

Another embodiment of the present disclosure is a structural dovetail panel comprising a plurality of dovetail flutes wherein each of the plurality of dovetail flutes comprise a top flange, portions of two bottom flanges, and two webs operatively coupling the top flange to the portions of the two bottom flanges, wherein the two webs converge from the top flange towards the portions of the two bottom flanges to form a flute cavity with a flute opening. The structural dovetail panel comprises a proximal edge comprising a proximal top flange and a proximal arm extending outwardly away from the structural dovetail panel and a distal edge comprising a distal top flange.

In further accord with embodiments, the proximal top flange is operatively coupled to a proximal bottom flange through a proximal web, and wherein the proximal arm extends outwardly away from the structural dovetail panel at a proximal arm angle that is less than or equal to a proximal web angle of the proximal web with respect to a proximal top flange plane.

In other embodiments, a distal arm extends from the distal top flange inwardly toward the structural dovetail panel.

In yet other embodiments, the proximal top flange is operatively coupled to a proximal bottom flange through a proximal web, and wherein the distal arm extends inwardly toward the structural dovetail panel at a distal arm angle that is less than or equal to a proximal web angle of the proximal web with respect to a proximal top flange plane.

Another embodiment of the present disclosure is a method of assembling a structural dovetail panel system. The method comprises assembling a first structural dovetail panel to one or more support members. The first structural dovetail panel comprises a plurality of first dovetail flutes wherein each of the plurality of first dovetail flutes comprise a first top flange, portions of two first bottom flanges, and two first webs operatively coupling the first top flange to the portions of the two first bottom flanges, wherein the two first webs converge from the first top flange towards the portions of the two first bottom flanges to form a first flute cavity with a first flute opening, and a first distal edge comprising a first distal top flange.

The method further comprises assembling a second structural dovetail panel to the first structural dovetail panel and the one or more support members. The second structural dovetail panel comprises a plurality of second dovetail flutes, wherein each of the plurality of second dovetail flutes comprise a second top flange, portions of two second bottom flanges, and two second webs operatively coupling the second top flange to the portions of the two second bottom flanges, wherein the two second webs converge from the second top flange towards the portions of the two second bottom flanges to form a second flute cavity with a second flute opening, and a second proximal edge comprising a second proximal top flange and a second proximal arm extending outwardly away from the second structural panel. The second proximal top flange and the second proximal arm are located over the first distal top flange to create a dovetail sidelap and a sidelap cavity with a sidelap opening.

The method further comprises forming one or more couplings in the sidelap to operatively couple the first structural dovetail panel to the second structural dovetail panel.

In further accord with embodiments, the second proximal top flange is operatively coupled to a second bottom flange through a second proximal web. The second proximal arm extends outwardly away from the second structural dovetail panel at a second proximal arm angle that is less than or equal to a second proximal web angle of the second proximal web with respect to a second proximal top flange plane.

In other embodiments, a first distal arm extends inwardly towards the first structural dovetail panel from the first distal edge, and wherein the second proximal top flange and the second proximal arm are located over the first distal top flange and the first distal arm.

In still other embodiments, the second proximal top flange is operatively coupled to a second bottom flange through a second proximal web. The first distal arm extends inwardly toward the first structural dovetail panel at a first distal arm angle that is less than or equal to a second proximal web angle of the second proximal web with respect to a second proximal top flange plane.

In yet other embodiments, the second proximal top flange and the first distal top flange are restricted from moving horizontally with respect to each other by the second proximal arm and the first distal arm.

In other embodiments, assembling the second structural dovetail panel to the first structural dovetail panel comprises moving a second proximal edge of the second structural dovetail panel towards a first distal edge of the first structural dovetail panel at an angle to allow the second proximal top flange and the second proximal arm to be located over the first distal top flange and the first distal arm.

In still other embodiments, the method further comprises assembling one or more dovetail anchors within the sidelap cavity.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein.

DETAILED DESCRIPTION

Figure 1A:
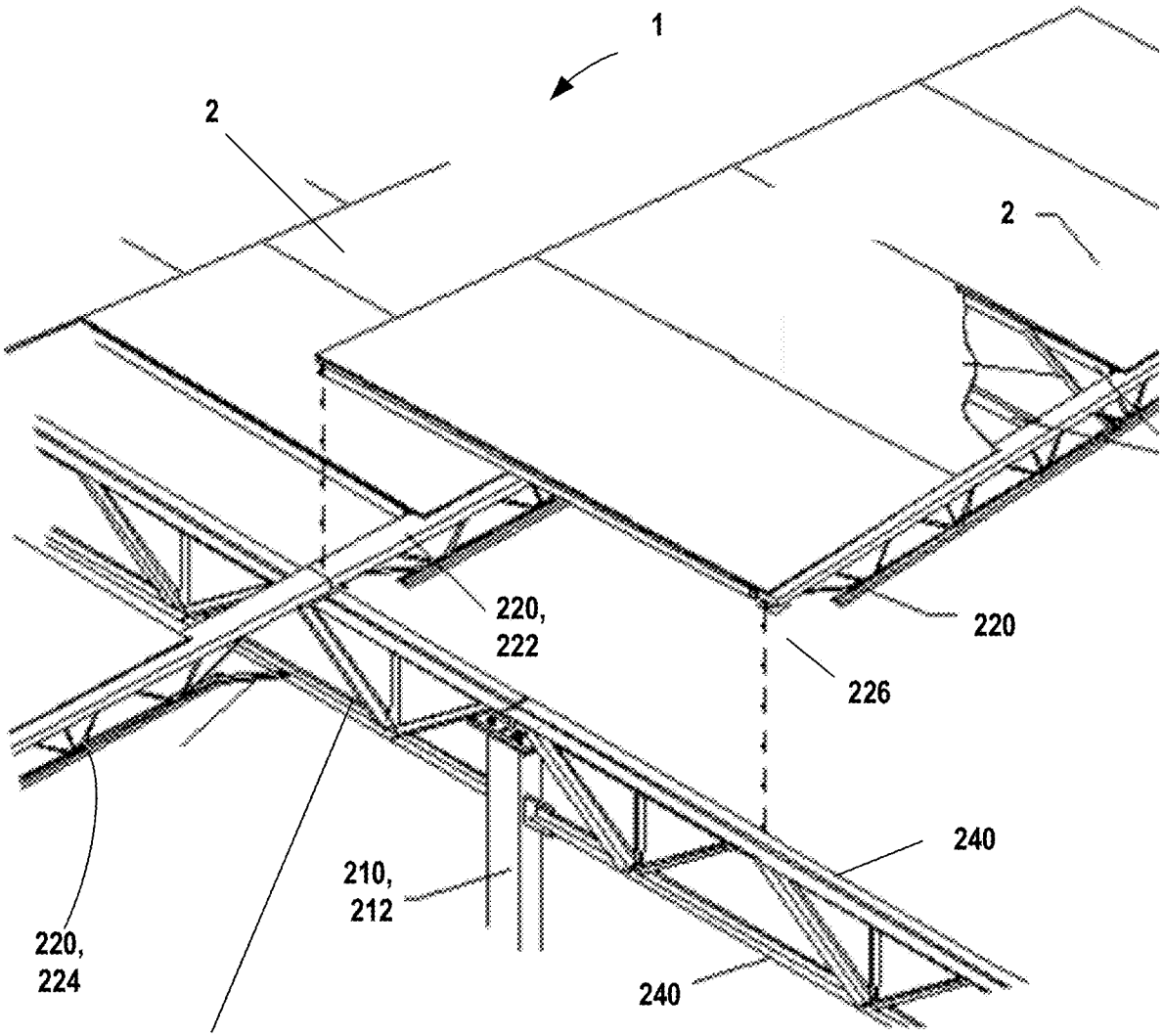
FIG. 1A illustrates a perspective view of a dovetail decking system, in accordance with embodiments of the present disclosure.

Embodiments of the present disclosure now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

The present disclosure relates to structural dovetail decking panel systems 1 (otherwise described as dovetail decking panel systems, dovetail decking systems, dovetail panel systems, or the like), structural dovetail decking panels 2 used in the dovetail decking panel systems 1, dovetail sidelaps 30 that allow for the use of anchors at the sidelaps, and methods of assembling the foregoing. Dovetail decking panel systems 1 comprise one or more support members 210 (e.g., beams, cold-formed steel (CFS), girders, joists, concrete walls, masonry walls, or other like support members), such as vertical support members 212 and/or horizontal support members 214. The horizontal support members 214 provide a location upon which two or more joists 220 are operatively coupled, such as a first joist 222 and a second joist 224. For example, in some embodiments the vertical support members 212 are columns, which support horizontal support members 214 that are joist girders. In turn, the joist girders support other horizontal support members 214 that are joists. The joist girders and joists may have similar configurations, as described in further detail below. However, it should be understood that any type of horizontal support members 214 may be used, including joist girders and joists having different configurations from what is described below.

Figure 1B:
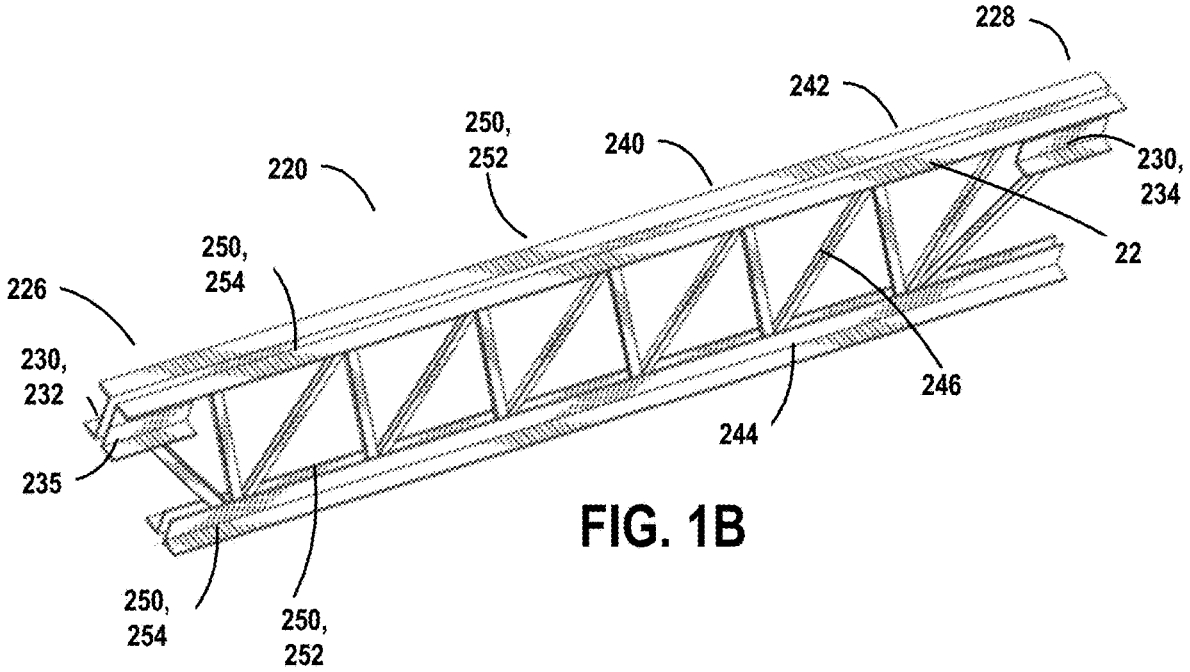
FIG. 1B illustrates a perspective view of one type of joist for a dovetail decking system, in accordance with embodiments of the present disclosure.
Figure 1C:
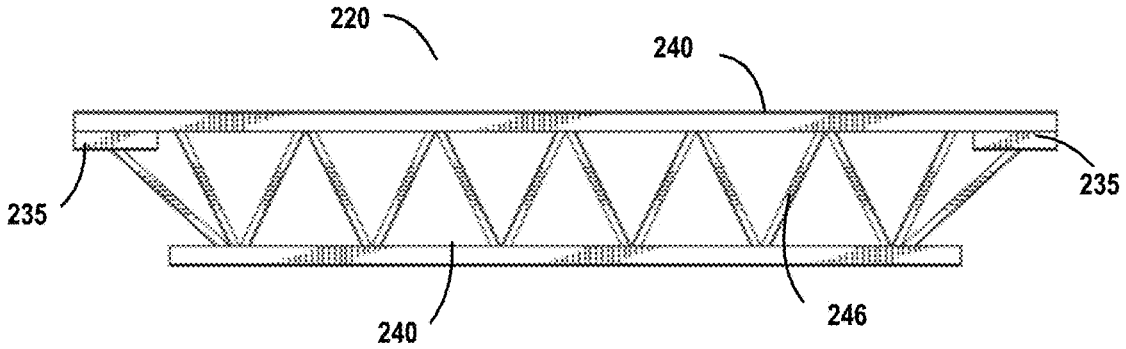
FIG. 1C illustrates a side view of one type of joist for a dovetail decking system, in accordance with embodiments of the present disclosure.

Each joist may have a proximal end 226 and a distal end 228 (illustrated in FIGS. 1B and 1C). A joist seat 230 may be located on one or more of the ends of the joists 220, such as a first joist seat 232 on the first joist 222 and a second joist seat 234 on the second joist 224. Each joist 220 may further comprise multiple chords 240, such as an upper chord 242 and a lower chord 244, which are operatively coupled through the use of joist webs 246. It should be understood that in some embodiments the joist seats 230 may comprises a portion of the upper chord 242 and a seat chord 235, such as a lower seat chord. In some embodiments the upper chord 242 may be directly operatively coupled to the seat chord 235; however, in other embodiments the upper chord 242 may be spaced apart from the seat chord 235 and/or coupled through a joist web 246. In other embodiments it should be understood that the joist seat 230 may comprise of two or more seat chords 235, such as a lower seat chord and an upper seat chords (not illustrated). The upper seat chord and lower seat chord may look like the joist seat 230 illustrated in FIG. 1, but may be separate from the upper chord 242, such that the upper chord 242 is located adjacent, above, or below the top of the joist seat 230.

Each of the chords 240 (e.g., upper chord, lower chord, and/or one or more seat chords) of the joists 220 may comprise one or more chord members, such as angle members 250 (e.g., L-shaped member, or the like). For example, a chord 240 may comprise of a first angle member 252 and a second angle member 254 operatively coupled to each other through one or more spacers (not illustrated) and/or the joist webs 246. In some embodiments, joist webs 246 may comprise angle members, channel members, rods, rebar, or other like members that are operatively coupled between a first angle member 252 and second angle member 254 of each chord 240 (e.g., upper chord 242, lower chord 244, one or more seat chords 235, or the like). While the the chord members 252, 254 and webs members 246 are generally described and illustrated has being L-shaped angle members, the chord members 252, 254 and/or web members 246 may comprise a suitable cross-section of any shape, such as a substantially "C" shape, "L" shape, "V" shape, "U" shape, square shape, rectangular shape, tubular shape, rolled uniform or non-uniform shape, and/or other like shape. In the embodiments illustrated in figures, each of the angle members 252, 254 of the joists 220 comprise an "L" shape. As such, the angle members 252 and 254 are operatively coupled to each other (e.g., comprising of two "L" shaped angles, or the like), such as through the use of couplings (e.g., fasteners, welds, or the like).

While specific types of joists 220 are described, it should be understood that the dovetail decking system 1 may utilize any type of joists 220 (e.g., roll formed, bar, beam, steel, wood, composite, or other like joists). As such, the structural dovetail decking panels 2 described herein may be operatively coupled to any type of joist 220 and/or other like support members 210.

Figure 2A:
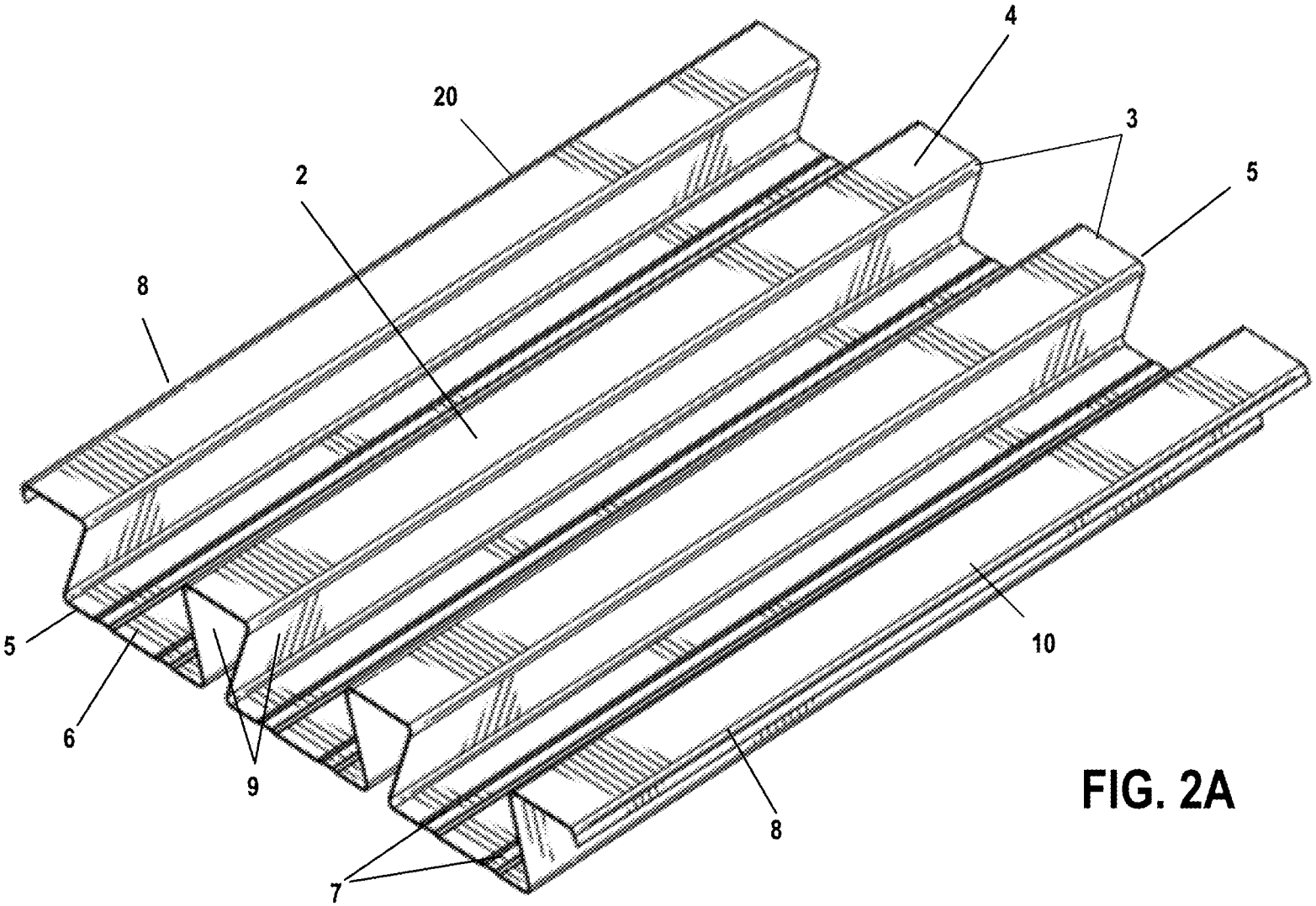
FIG. 2A illustrates a perspective view of a portion of a structural dovetail decking panel, in accordance with embodiments of the present disclosure.
Figure 2B:
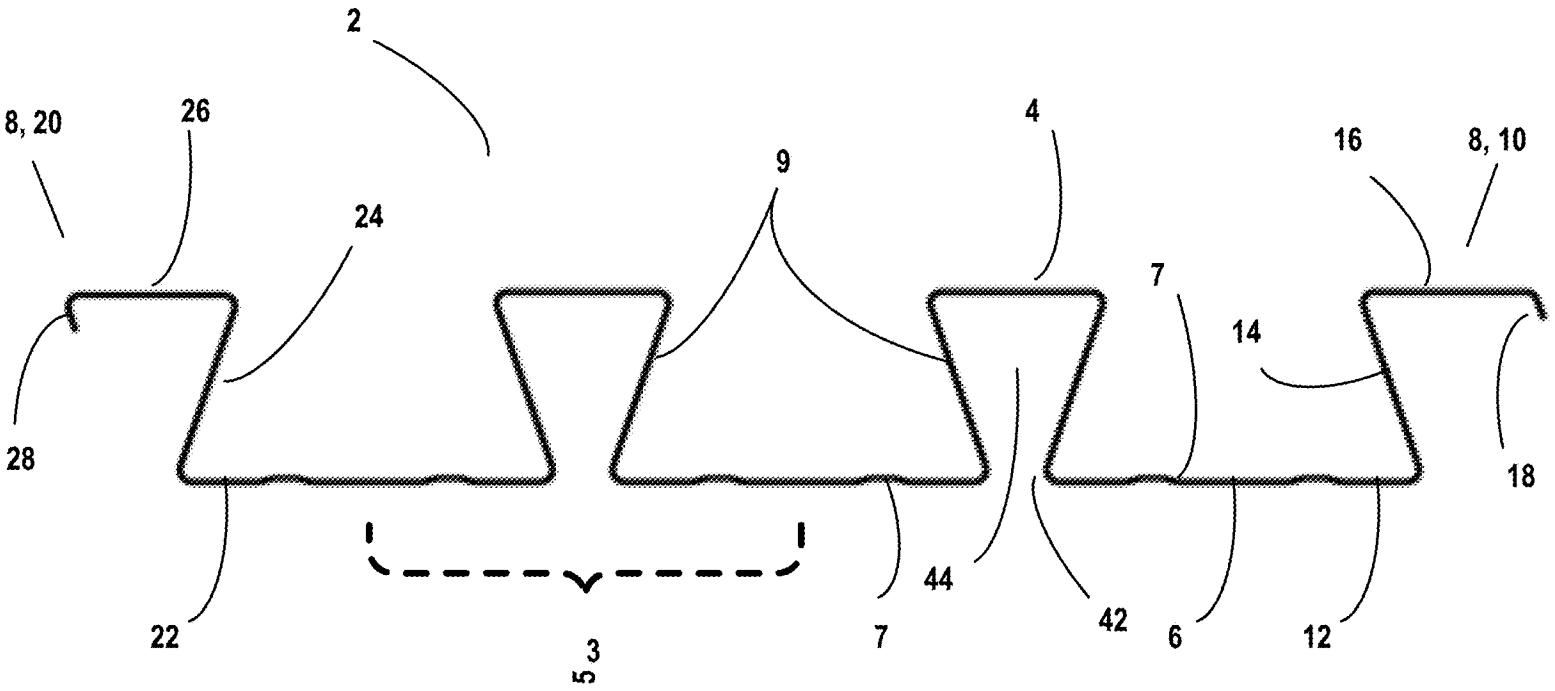
FIG. 2B illustrates an end view of a portion of the structural dovetail decking panel of FIG. 1, in accordance with embodiments of the present disclosure.

As illustrated in FIGS. 2A and 2B, structural dovetail decking panels 2 (otherwise described as dovetail decking panels, decking panels, dovetail decking, dovetail panels, or the like) may be provided with two edges 8, a proximal edge 10 and a distal edge 20. The proximal edge 10 may have a proximal top flange 16 and a proximal arm 18 extending from the proximal top flange 16 outwardly away from the dovetail decking panel 2. The distal edge 20 may have a distal top flange 26 and a distal arm 28 extending inwardly towards the dovetail decking panel 2. When adjacent dovetail decking panels are joined, the proximal edge 10 having the proximal arm 18 of a panel 2 is placed over the distal edge 20 having the distal arm 28 of the adjacent panel 2 to create a dovetail sidelap 30. The proximal top flange 16, the proximal arm 18, the distal top flange 26, and/or the distal arm 28 aid in restricting movement of the proximal edge 10 and the distal edge 20 of adjacent panels 2*a*, 2*b* in order control the dimensions of a sidelap cavity and sidelap opening in the dovetail sidelap 30. The dovetail sidelap 30 that utilizes the proximal arm 16 and/or the distal arm 18 improves the strength of the dovetail decking panel systems 1, allows for the reduction of the thickness of the panels 2 or number of couplings 50 used due to the improved strength, and/or allows for anchors 100 to be utilized within the sidelap cavity 34 due to improved control of the dimensions of the dovetail sidelap 30.

The structural dovetail panels 2 used to form structural decking systems 1 may be manufactured from a variety of rigid materials including steel, aluminum, titanium, plastic, a composite, or another type of rigid material. Typical structural panels are made of steel and are sized in ranges from 12 inches to 42 inches wide by 1 foot to 50 feet long. These dimensions include some sizes of structural panels 2, but it should be understood that any size of structural panels 2 within these ranges, overlapping these ranges, or outside of these ranges might be utilized with the present disclosure. The material thickness of the structural panels 2 may be any thickness; however, typical panel thicknesses may be 29 gage panels to 16 gage panels, inclusive (or up to 14 gage, inclusive). Other material thicknesses of the present invention may be within this range, overlap this range, or be located outside of this range.

As illustrated throughout the figures, the structural panels 2 are dovetail decking panels 2 that include top flanges 4 (otherwise described as peaks, upper flanges, outer flanges, or the like), bottom flanges 6 (otherwise described as troughs, lower flanges, inner flanges, or the like), and webs 9 (e.g., the portions of the panel that are sloped with respect to the flanges 4, 6) that operatively couple the top flanges 4 to the bottom flanges 6, all of which will be generally discussed in further detail below. The combination of top and bottom flanges 4, 6, and the webs 9 create a flute 3 for the structural dovetail panels 2. The distance from the top of the top flange 4 and the bottom of the bottom flange 4 may generally range from a ½ inch to 3½ or 4 inches in depth; however, other ranges of depths within these ranges, overlapping these ranges, or outside of these ranges may be used in the profiles. For example, in some embodiments the distance may range from ½ inch to 12 inches in depth, or the like. The dovetail panels 2 may or may not include longitudinal ribs 7, bends, or cutouts that impact the moment of inertia and section modulus of the panels 2 (e.g., profile dimensions, ribs, cutouts, or the like are used to target different performance characteristics, such as but not limited to strength and/or stiffness). Moreover, in some embodiments the bottom flanges 6 or webs 9 may include apertures for acoustical applications. In the illustrated embodiment, two ribs 7 are located within the bottom flange 6 of the decking. The ribs 7 provide improved structural strength for the dovetail decking panels 2, as well as providing for the optimal location for the use of stand-off fasteners and/or improved fire ratings, as will be discussed in further detail herein. Depending on the material thickness (i.e., gauge), the length and width of the dovetail panels 2, and the height set by the top flanges 4 and bottom flanges 6, the dovetail panels 2 may weigh between 100 and 420 lbs. In other embodiments, the weight of the panels may be within, overlap, or be located outside of this range.

As previously discussed above, adjacent decking panels 2 located parallel to each other are operatively coupled together at the edges 8. Moreover, decking panels 2 located longitudinally in series with each other have ends 5 that may or may not be butted against each other (e.g., the ends 5 of adjacent decking panels 2 may or may not touch). The decking panels 2 located longitudinally in series with each other may be operatively coupled to the same support member 210 (e.g., a wall, a girder between columns, or the like) or joist support member 214 located between other support members 212 (e.g., vertical support members), or the like. As will be described in further detail herein with respect to FIGS. 6A and 6B, in some embodiments when the panel ends 5 meet at a support member 210 (e.g., a wall area of a structure, or the like) the panels 2 may be offset from one another.

The sizes and thicknesses of the structural dovetail decking panels 2 are determined based on the engineering requirements for the desired application of the structural dovetail decking systems 1. In one particular embodiment of the invention, the structural dovetail decking panels 2 are used as roofs, floors, and/or walls within a building, and are required to meet the structural requirements for withstanding potential seismic activity, high winds, and/or other natural or man-made forces (e.g., gravity, or the like). As discussed in further detail below, if the sidelap is not properly aligned between the structural dovetail decking panels 2 and/or couplings 50 are not properly spaced within the dovetail sidelap 30, the weakest location of the roof, floors, and/or walls may be along the dovetail sidelap 30 of the roof, floors, and/or walls.

As described herein, the present invention provides improved dovetail sidelaps 30 with improved strengths, and in particular, improved strengths with respect to out-of-plane loading due to the overlap of the full flanges. Since the dovetail sidelaps 30 provide increased out-of-plane strengths (e.g., bending strength, stiffness, or the like) and/or shear strengths, it allows for a reduced thickness of the structural dovetail decking panels 2 and/or couplings 50 that are spaced farther apart from one another without decreasing the strength of the overall decking system 1. The reduced thickness of the structural dovetail decking panels 2 and/or the reduced number of couplings 50 reduces the material costs (e.g., less steel in the panels 2, less couplings 50, or the like) and/or labor costs (e.g., panels 2 are easier to maneuver, not as many couplings 50 required installation, or the like) associated with the structural decking systems 1 of the present invention, when compared with other structural decking systems that have the same or similar shear strength. Additionally, the dovetail sidelap 30 aids in forming a dovetail sidelap opening 32 and dovetail sidelap cavity 34 at the dovetail sidelap 30 that are consistent with the dovetail flute openings 42 and dovetail flute cavities 44 of the flutes 3 that are not created by the dovetail sidelap 30 (e.g., that occur between the edges 8 of the panels 2). As such, the dimensions of the dovetail sidelap opening 32 (otherwise described as sidelap gap, sidelap opening, or the like) and the dovetail sidelap cavity 34 (otherwise described as sidelap cavity) provides improvements for utilizing anchors (e.g., connectors, hangers, fasteners, or the like). It should be understood that anchors may include any type of mechanical device that can be non-destructively (e.g., bearing against surfaces of the panels, or the like), or destructively (e.g., pierces, deforms, or the like the panel, concrete, or the like), operatively coupled to the decking system 1 (e.g., panel, concrete, or the like). As will be discussed in further detail herein, the dovetail sidelap 30 of the present disclosure (unlike traditional dovetail sidelaps) allows anchors 100 to be utilized at the dovetail sidelap 30. Furthermore, the use of two ribs 7 in the bottom flange 6 allows shear fasteners (e.g., such as welded shear studs, stand-off fasteners, or other like fasteners) to be placed in the center between the two ribs 7, which provides the most strength when concrete is poured over the dovetail decking panel 2 and encapsulates the shear fasteners. Other decking that includes a groove, v-shape, or other feature at the center of the bottom flange requires installation of the shear fasteners offset of the center of the bottom flange, which reduces the strength that the shear fasteners provide to traditional decking systems.

Each structural dovetail decking panel 2 may be formed (e.g., roll-formed, or the like) into the desired profile. In some embodiments, the dovetail decking panels 2 may have a height of 2" and a width of 30", a height of 3.5" and a width of 24", or other height and width dependent on manufacturing limitations, installation requirements, or the like. The structural dovetail decking panels 2 may be used as roof deck, acoustical roof deck (i.e., with apertures within the bottom flanges 6), floor deck (i.e., used with concrete poured over the dovetail decking panels 2), acoustic floor deck (i.e., with an additional component inserted into the bottom flange of the flute to enclose the insulation and/or keep concrete from passing through the apertures)

As illustrated in FIG. 2A, the dovetail decking panel 2 may have panel edges 8 (e.g., the opposite longer sides of the panel 2) comprising of a proximal edge 10 and a distal edge 20. As illustrated in FIG. 2B, the proximal edge 10 may comprise of at least a portion of a proximal bottom flange 12, a proximal web 14, a proximal top flange 16, and a proximal arm 18. As also illustrated in FIG. 2B, the distal edge 20 may comprise of at least a portion of a distal bottom flange 22, a distal web 24, a distal top flange 26, and a distal arm 28. The proximal arm 18 is illustrated as extending outwardly away from the dovetail decking panel 2. The proximal arm 18 extends outwardly at an angle with respect to the plane of the proximal top flange 16 that is less than or equal to the angle of the proximal web 14 with respect to the plane of the proximal top flange 16. The distal arm 28 extends inwardly at an angle with respect to a plane of the distal top flange 26 that is less than or equal to the angle of the proximal web 14 with respect the plane of the proximal top flange 26. The angles of the proximal arm 18 and the distal arm 28 facilitate the assembly of a first dovetail decking panel 2*a* and a second dovetail decking panel 2*b*, as will be described in further detail herein.

Figure 3A:
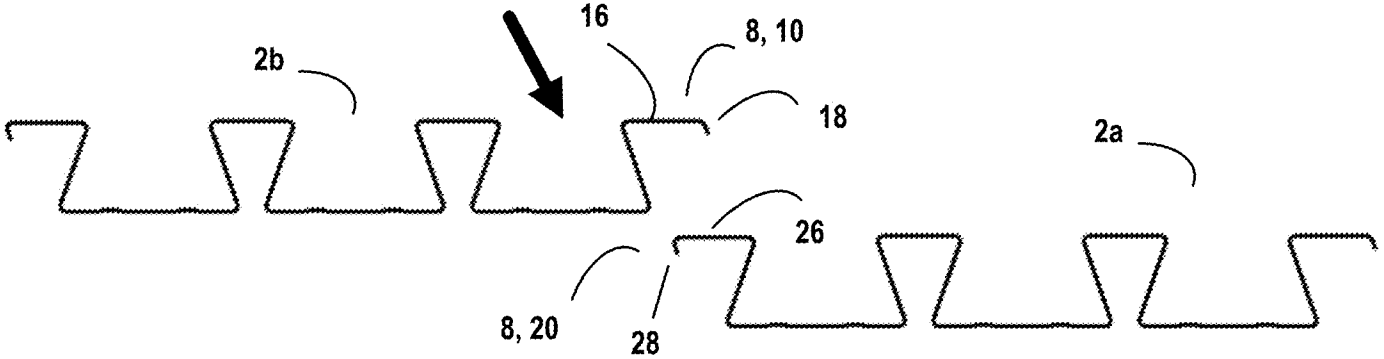
FIG. 3A illustrates an end view of a second dovetail decking panel being assembled to a first dovetail decking panel, in accordance with embodiments of the present disclosure.
Figure 3B:
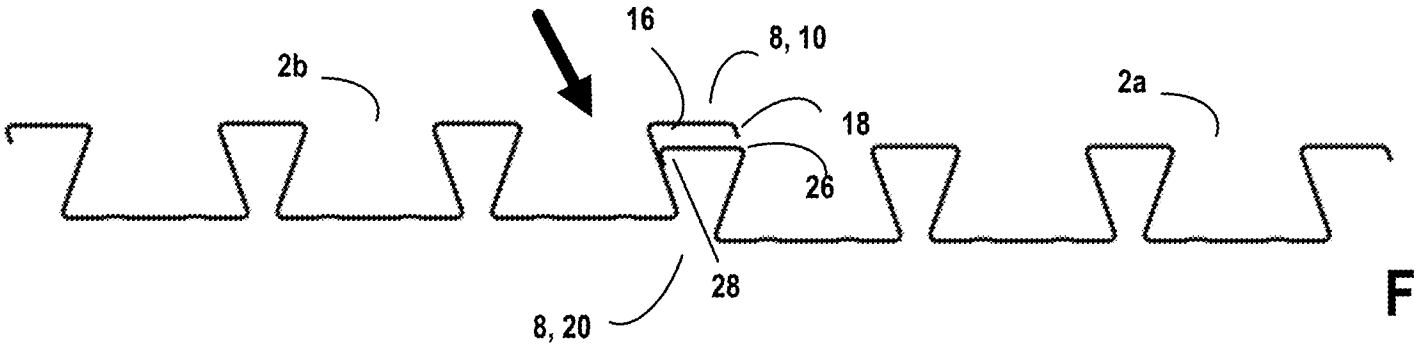
FIG. 3B illustrates an end view of a second dovetail decking panel being assembled to a first dovetail decking panel, in accordance with embodiments of the present disclosure.
Figure 3C:
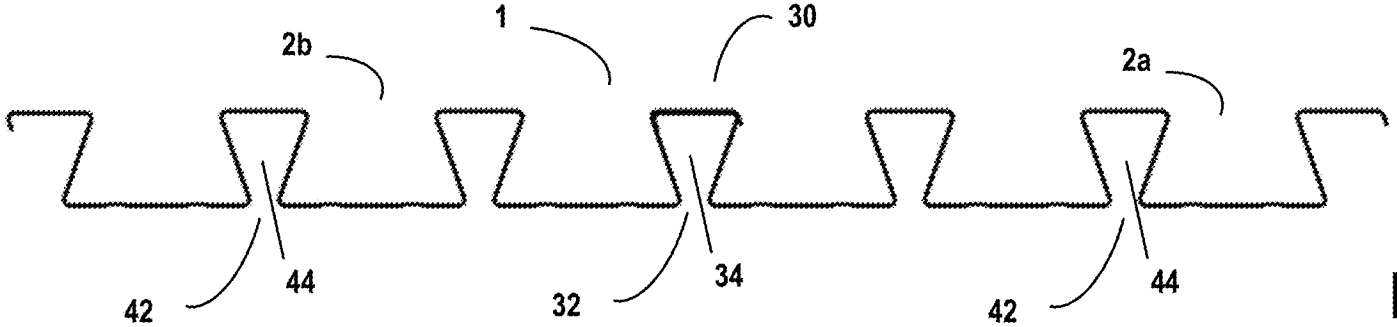
FIG. 3C illustrates an end view of a second dovetail decking panel assembled to a first dovetail decking panel, in accordance with embodiments of the present disclosure.

FIGS. 3A through 3C illustrate the assembly of a second dovetail decking panel 2*b* over a first dovetail decking panel 2*a* (e.g., which first dovetail decking panel 2*a* may or may not have already been operatively coupled to support members, such as joists 220, of a dovetail decking system 1) to form a dovetail sidelap 30. As illustrated by FIG. 3A, the second dovetail decking panel 2*b* is assembled by moving the second dovetail decking panel 2*b* at an angle (e.g., at an angle that is approximately the same as the proximal arm 18, the proximal web 14, and/or the distal arm 28) towards the distal edge 20 of the first dovetail decking panel 2*a*. As illustrated in FIGS. 3B and 3C, the angles of the proximal arm 18 and the distal arm 28 allow the second dovetail decking panel 2*b* to be placed over the first dovetail decking panel 2*a*, while still allowing for the proximal edge 10 of the second decking panel 2*b* and the distal edge 20 of the first decking panel 2*b* to have a full proximal top flange 16 and a full distal top flange 26 (e.g., full width and not just a portion of the top flange). Moreover, the angles of the proximal arm 18 and the distal arm 28 further allow for the proximal edge 10 and distal edge 20 of the sidelap 30 to use the arms 18, 28 of the edges 10, 20 to restrict the movement of the panels 2*a*, 2*b* horizontally with respect to each other.

Figure 4A:
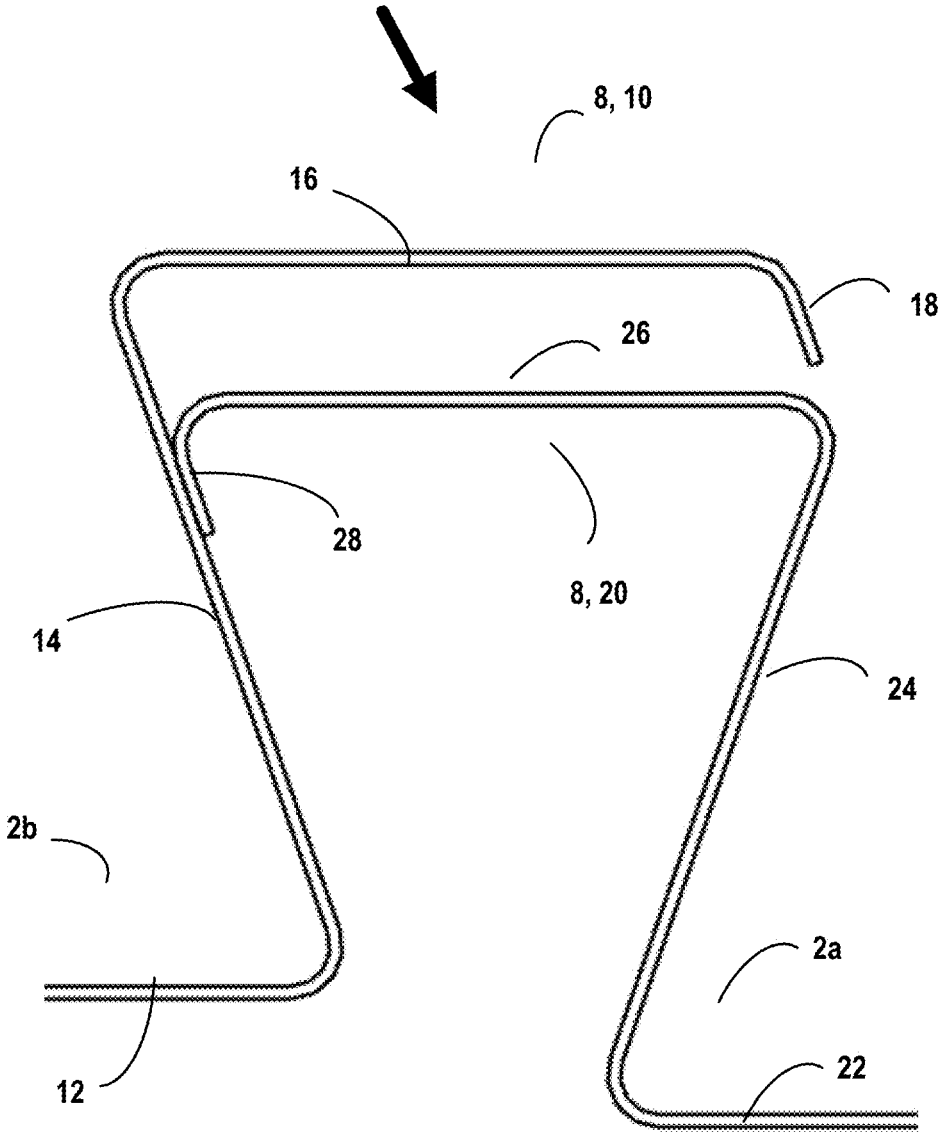
FIG. 4A illustrates an enlarged end view of a second dovetail decking panel being assembled to a first dovetail decking panel in one way to create a dovetail sidelap, in accordance with embodiments of the present disclosure.
Figure 4B:
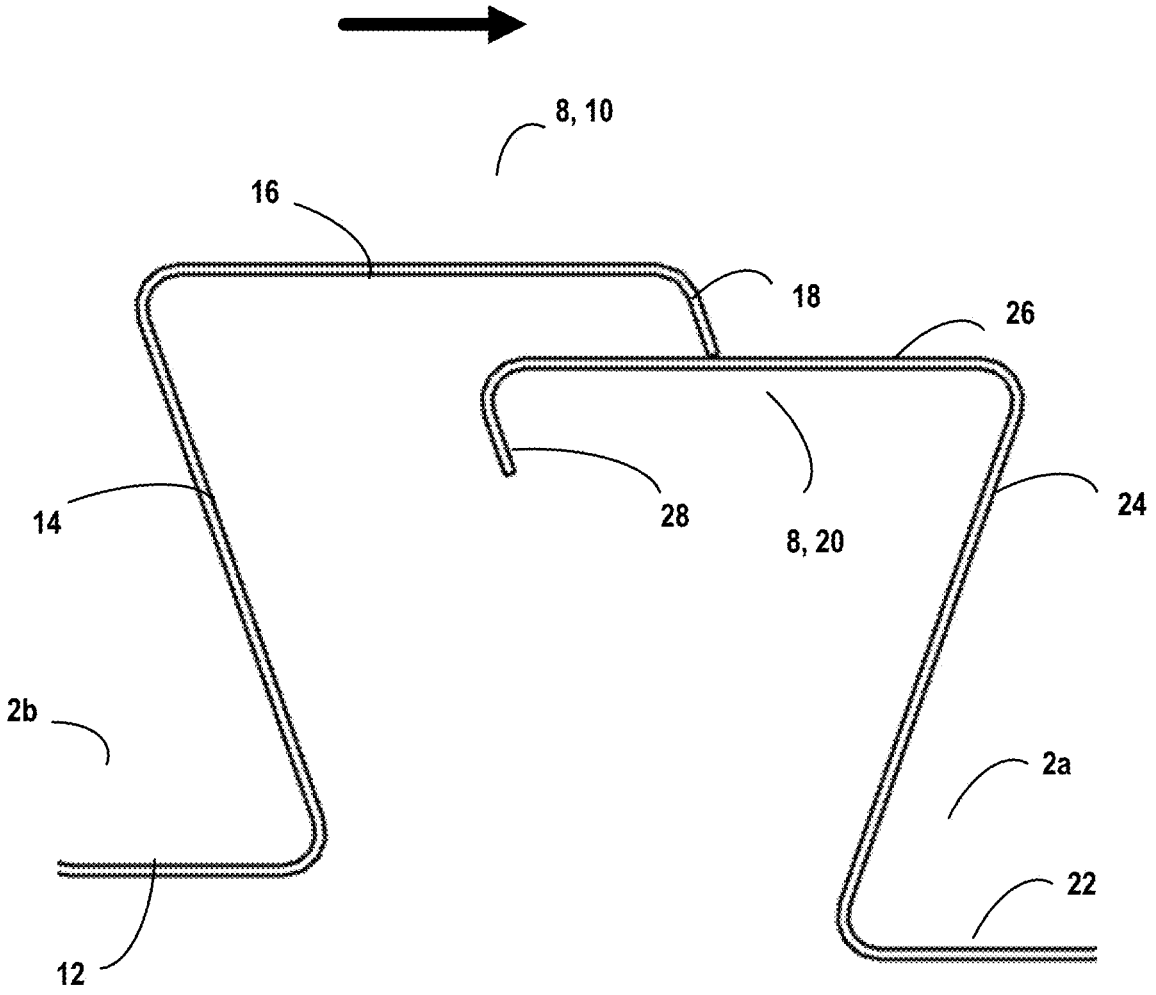
FIG. 4B illustrates an enlarged end view of a second dovetail decking panel being assembled to a first dovetail decking panel in an alternate way to create a dovetail sidelap, in accordance with embodiments of the present disclosure.
Figure 4C:
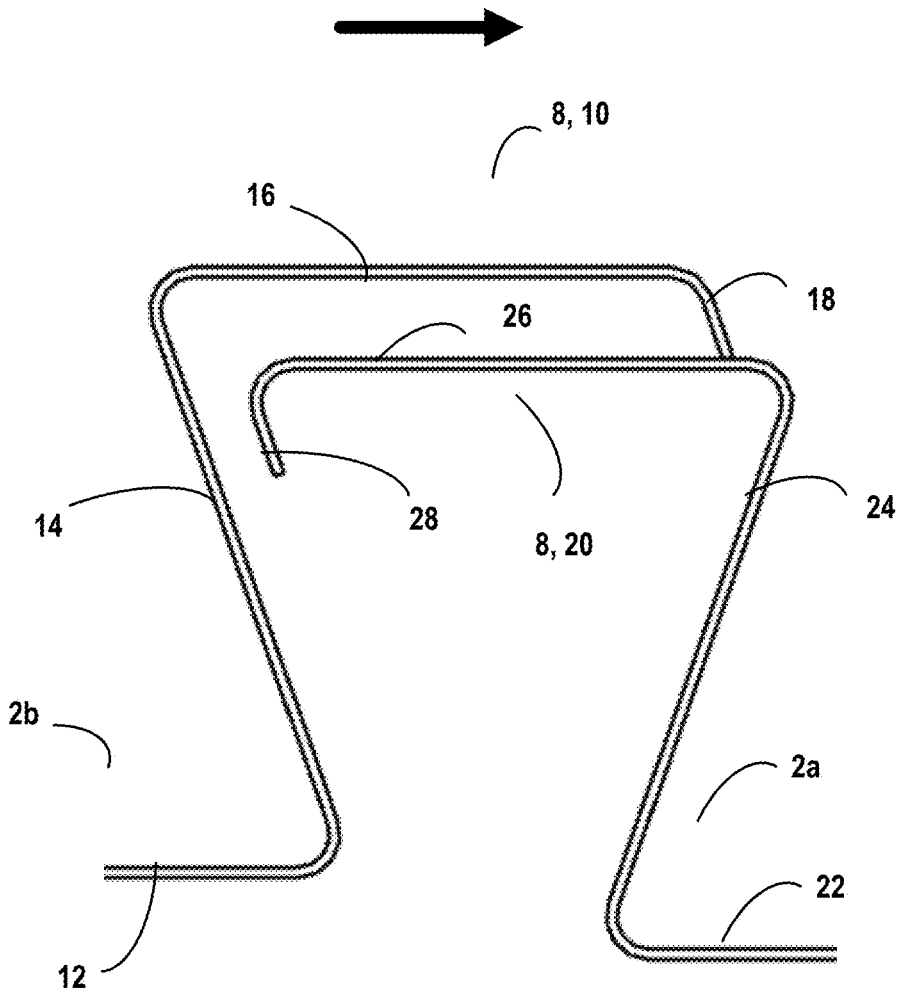
FIG. 4C illustrates an enlarged end view of a second dovetail decking panel being assembled to a first dovetail decking panel in the alternate way to create a dovetail sidelap, in accordance with embodiments of the present disclosure.
Figure 4D:
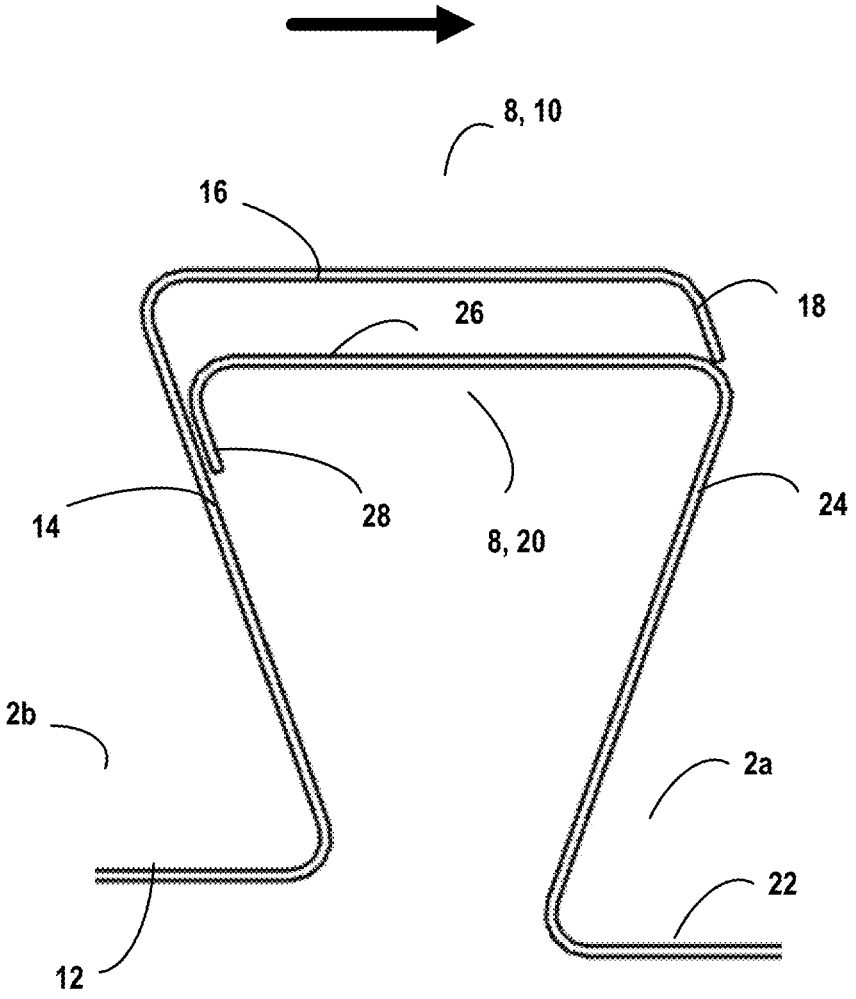
FIG. 4D illustrates an enlarged end view of a second dovetail decking panel being assembled to a first dovetail decking panel in the alternate way to create a dovetail sidelap, in accordance with embodiments of the present disclosure.
Figure 4E:
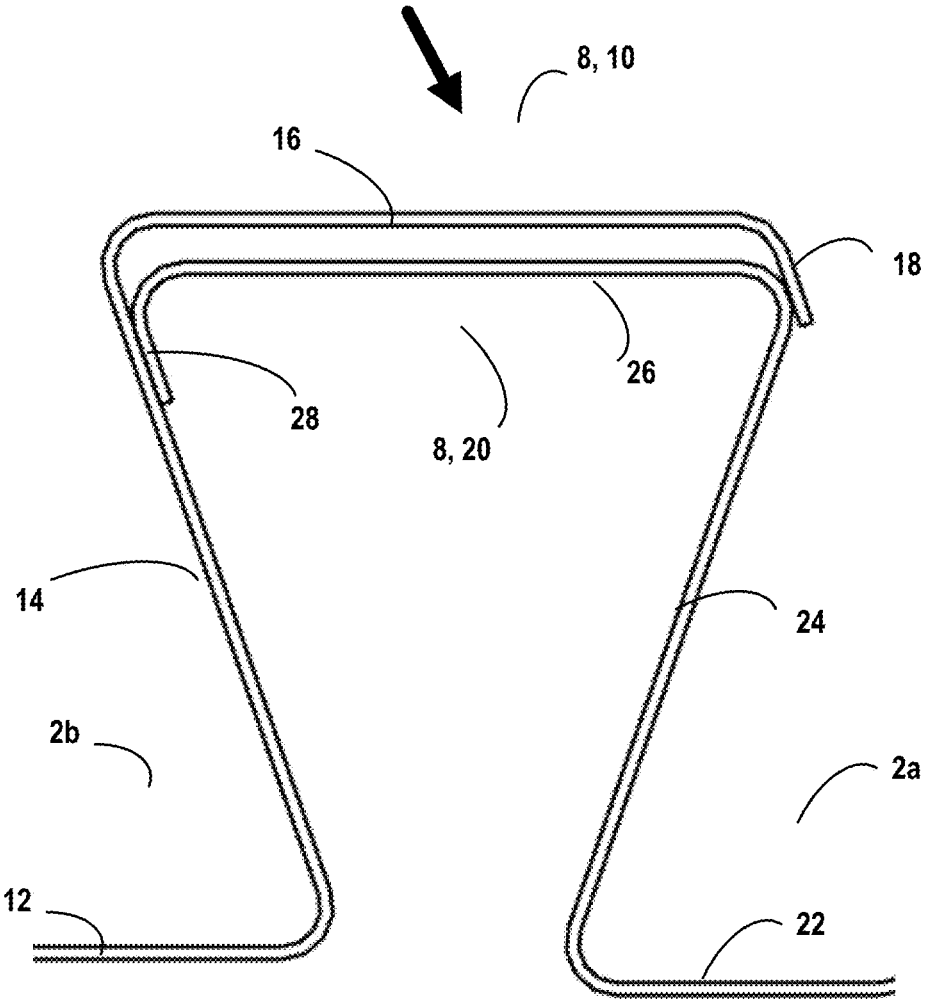
FIG. 4E illustrates an enlarged end view of a second dovetail decking panel being assembled to a first dovetail decking panel to create a dovetail sidelap, in accordance with embodiments of the present invention.
Figure 4F:
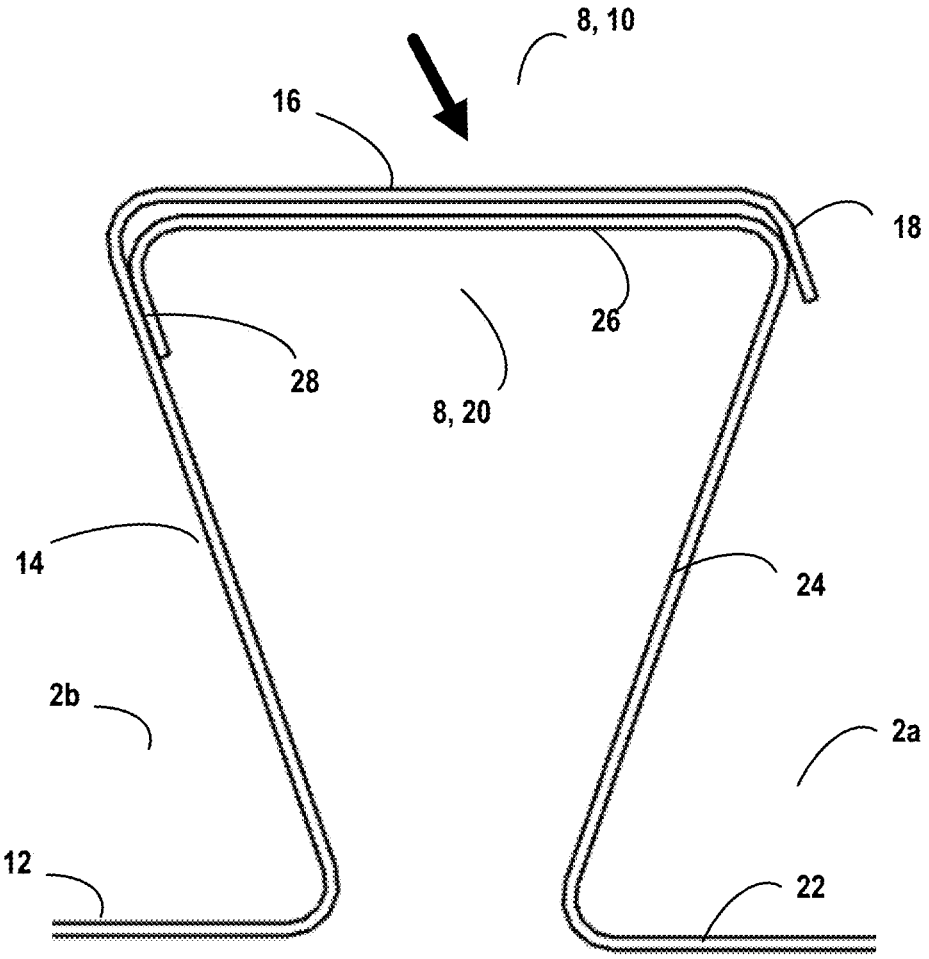
FIG. 4F illustrates an enlarged end view of a second dovetail decking panel being assembled to a first dovetail decking panel to create a dovetail sidelap, in accordance with embodiments of the present disclosure.
Figure 4G:
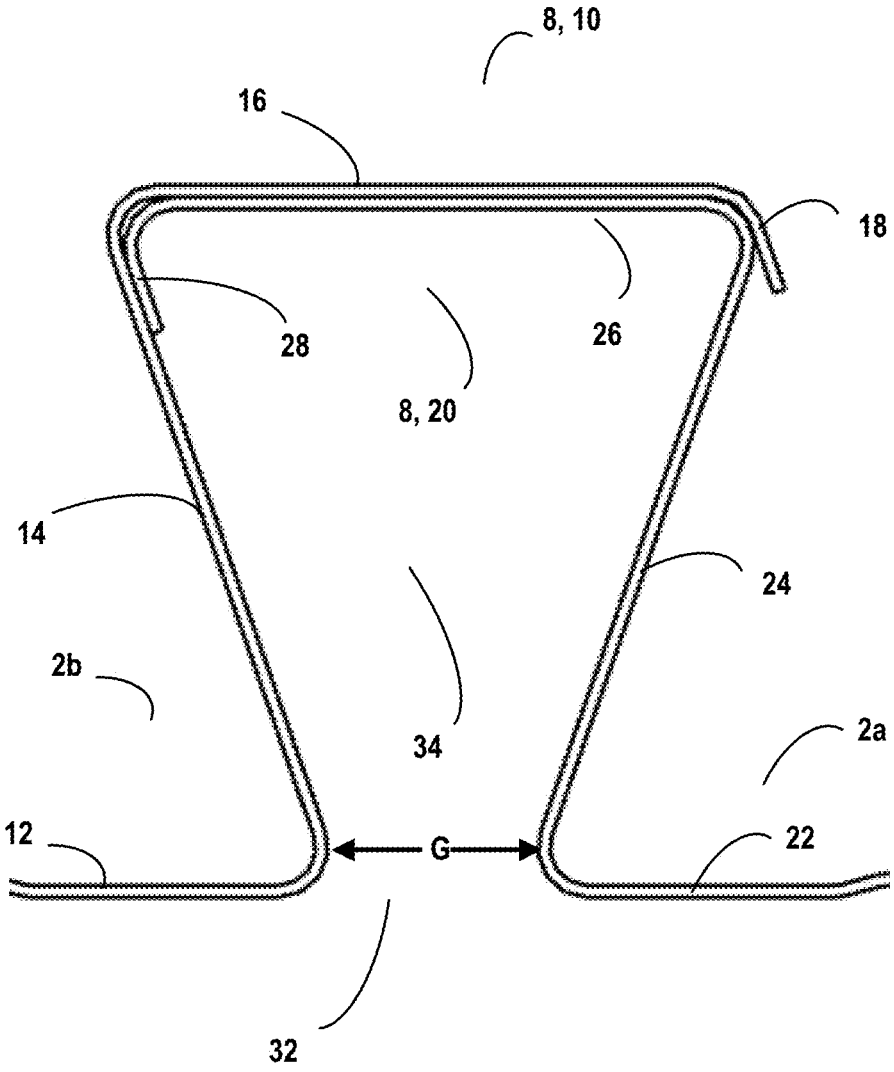
FIG. 4G illustrates an enlarged end view of a second dovetail decking panel assembled to a first dovetail decking panel to create a dovetail sidelap, in accordance with embodiments of the present disclosure.
Figure 4H:
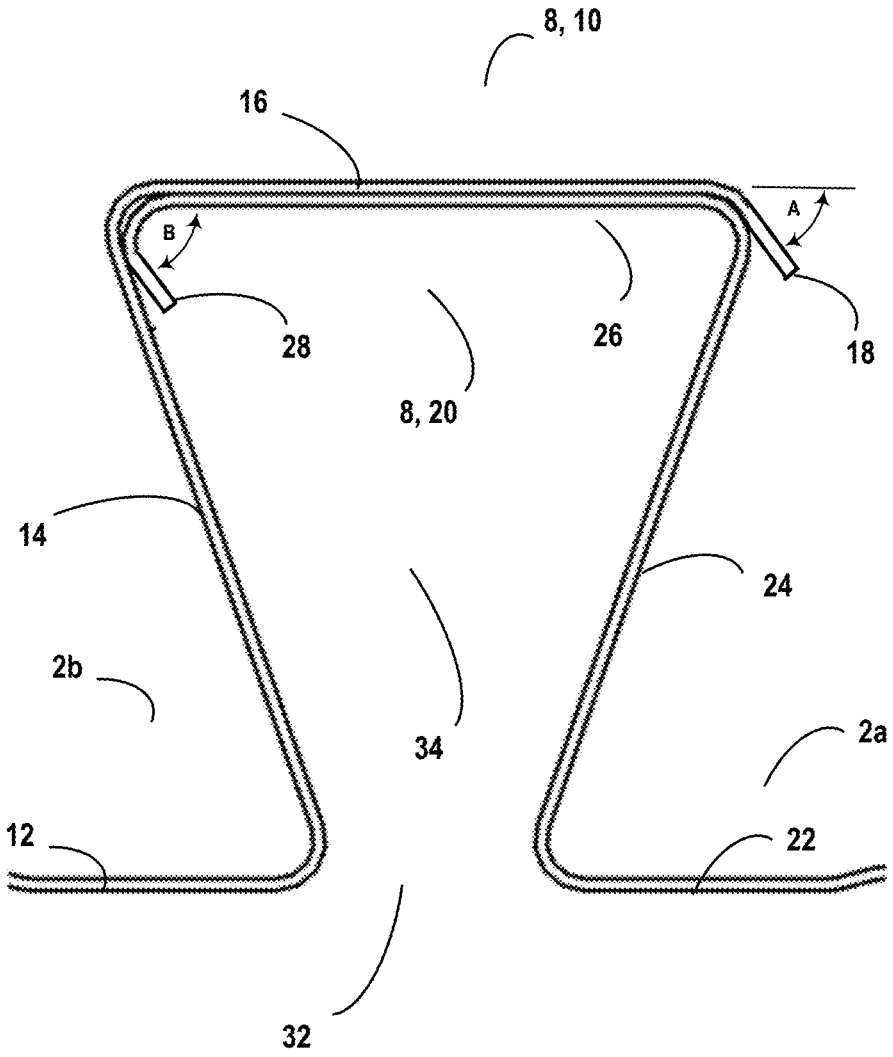
FIG. 4H illustrates an enlarged end view of a second dovetail decking panel assembled to a first dovetail decking panel to create a dovetail sidelap having alternate distal and proximate arm angles on the distal edge and proximal edge of adjacent dovetail decking panels, in accordance with embodiments of the present disclosure.

The assembly described in FIGS. 3A through 3B is illustrated in an enlarged view in FIG. 4A. Moreover, alternate assembly processes are illustrated in enlarged views in FIGS. 4B through 4D (e.g., wherein the proximal arm 18 of the second dovetail decking panel 2*b* is slid over the distal top flange 26 of the distal edge 20 of the first dovetail decking panel 2*a*). Moreover, regardless of the processes used with respect to FIG. 4A or FIGS. 4B through 4D, the second dovetail decking panel 2*b* may slide over the first dovetail decking panel 2*a* as illustrated in FIGS. 4E through 4G to form the dovetail decking sidelap 30 having full top flanges 16, 26. As such, as illustrated in FIGS. 3A through 3C and FIG. 4A the second dovetail decking panel 2*b* may slide over the first dovetail decking panel 2*a* by the installers moving the second dovetail decking panel 2*b* at an angle (e.g., with respect to the horizontal orientation of the first dovetail decking panel 2*a*). Alternatively, should the installers be located on the side of the second dovetail decking panel 2*b* adjacent the first dovetail decking panel 2*a* (e.g., on the first decking panel 2*a*, or the like) or located on the side the second dovetail decking panel 2*b* opposite from the first dovetail decking panel 2*a* (e.g., on a beam, or the like), the installers may place the second dovetail decking panel 2*b* such that the proximal arm 18 of the second dovetail decking panel 2*b* engages the distal top flange 26 of the distal edge 20 of the first decking panel 2*a*, as illustrated in FIG. 4B. Moreover, as illustrated in FIGS. 4C and 4D, the installers may pull (e.g., when located on the side of the second dovetail decking panel 2*b* adjacent the first dovetail decking panel 2*b*) and/or may push (e.g., when located on the side of the second dovetail decking panel 2*b* opposite from the first dovetail decking panel 2*a*) in order to slide the second dovetail decking panel 2*b* horizontally. As illustrated in FIGS. 4E, 4F, and 4G, regardless of if the decking panels 2*a*, 2*b* are assembled as shown in FIGS. 4A and/or FIG. 4B through 4D, the second dovetail decking panel 2*b* may slide into place at an angle to form the unjoined (e.g., before couplings are formed) dovetail sidelap 30.

Unlike traditional dovetail decking sidelaps, which allows for horizontal movement at the sidelap during installation until the edges are coupled, as illustrated in FIG. 4G when the panels 2 are assembled, the arms 18, 28 restrict the movement of the edges 10, 20 with respect to each other, which maintains the sidelap dovetail opening 32 (illustrated by reference G) and the sidelap dovetail cavity 34 dimensions. As such, the sidelap dovetail opening 32 and sidelap dovetail cavity 34 have the same size (e.g., apart from natural tolerance differences) as the fluted dovetail openings 42 and fluted dovetail cavities 44 that are rolled into the dovetail decking panels 2. Consequently, anchors, such as the anchors 100 illustrated in the figures described in further detail below, can be used within the dovetail sidelap 30, the strength of the dovetail side lap is improved, and the dovetail sidelap 30 looks the same as the fluted dovetails (e.g., the sidelap dovetail opening 32 looks the same as the fluted dovetail opening 42 from underneath providing improved aesthetics when viewing the decking after installation).

It should be understood that the proximal arm 18 angle A and the distal arm 28 angle B, with respect to the top flange 4 plane, have been illustrated generally in FIGS. 3A through 4D as being the same angle as the proximal web 14 with respect to the top flange 4 plane. However, as illustrated in FIG. 4H, it should be understood that the angles A and/or B may be less than the angle of the proximal web 14 with respect to the top flange 4 plane. While not specifically illustrated in the figures, it should be understood that in some embodiments the proximal arm 18 angle A and the distal arm 28 angle B with respect to the top flange 4 plane may be slightly larger than the proximal web 14 angle with respect to the top flange 4 plane; however, the flexing of the proximal arm 18 and the distal arm 28 (or the proximal or distal top flanges, webs, or bottom flanges) may still allow for the assembly of the second structural dovetail decking panel 2*b* over the first structural dovetail decking panel 2*a*.

While the proximal arms 18 and the distal arms 28 are illustrated as having a particular length, it should be understood that the proximal arms 18 and the distal arms 28 may be of any length, such that at least a portion of the proximal arms 18 extend past the curve in the corner between the distal top flange 26 and the distal web 24, and at least a portion of the distal arms 28 extends past the curve between the proximal top flange 16 and the proximal web 14. In some embodiments, the distal arm 28 has a distal arm length that is less than or greater than 0.1, 0.2, 0.25 (¼), 0.3, 0.33 (⅓), 0.35, 0.4, 0.45, 0.5 (½), 0.55, 0.6, 0.65, 0.66 (⅔), 0.7, 0.75 (¾), 0.8, 0.85, 0.9, or 0.95 the length of the proximal web 14. In some embodiments the proximal arm 18 has a proximal arm length that is less than or greater than 0.1, 0.2, 0.25 (¼), 0.3, 0.33 (⅓), 0.35, 0.4, 0.45, 0.5 (½), 0.55, 0.6, 0.65, 0.66 (⅓), 0.7, 0.75 (¾), 0.8, 0.85, 0.9, or 0.95 the length of the proximal web 14 and/or the distal web.

Figure 5:
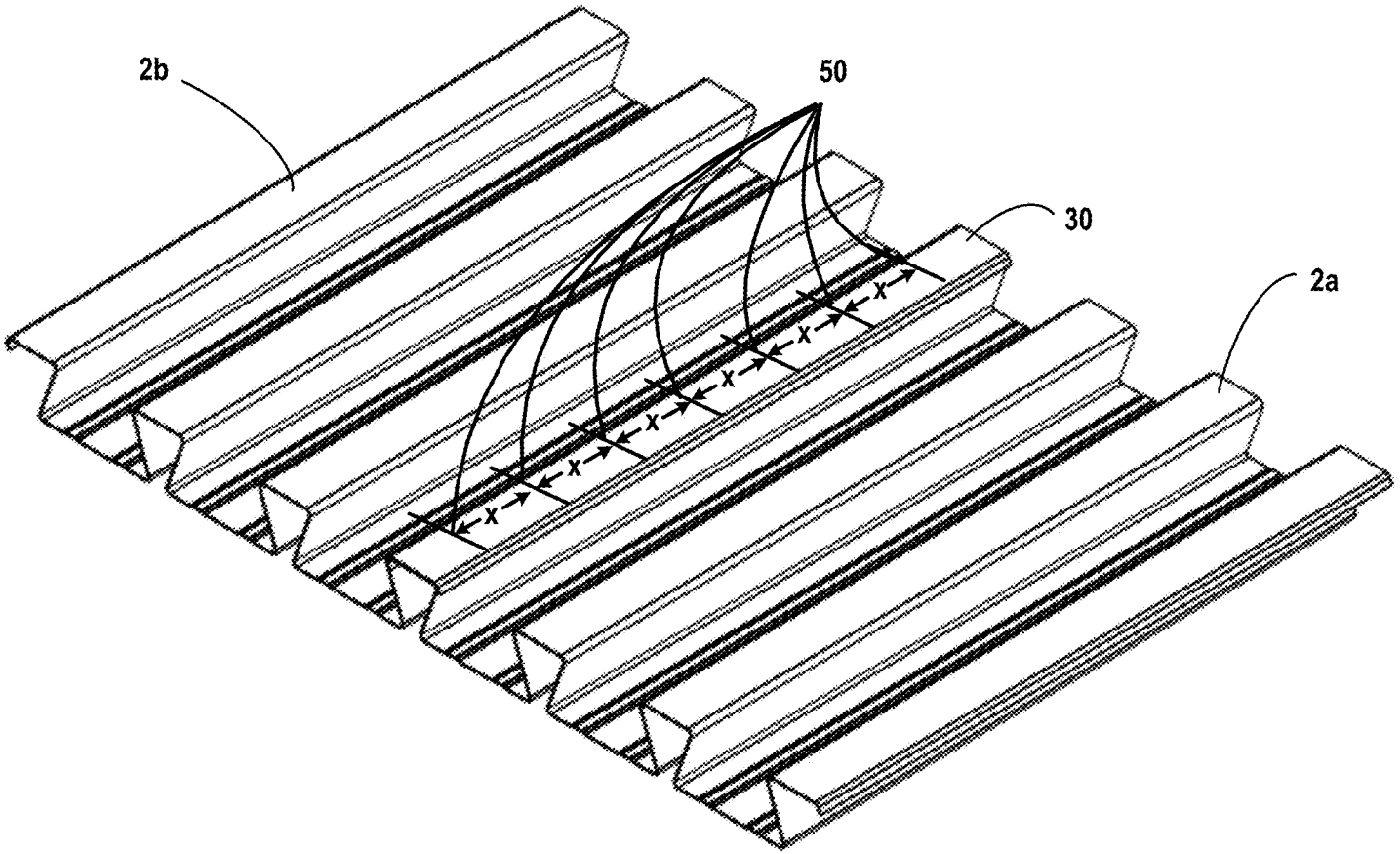
FIG. 5 illustrates a perspective view of dovetail decking being operatively coupled to each other with couplings, in accordance with embodiments of the present disclosure.

FIG. 5 illustrates a perspective view of the second dovetail decking panel 2*b* assembled over the first dovetail decking panel 2*a*, as well as the location of couplings 50 (otherwise described as connectors, or the like) within the sidelap 30 formed by the two assembled dovetail decking panels 2. It should be understood that the couplings 50 may be any type of coupling, such as but not limited to, fasteners (installed in pre-drilled holes, self-drilling fasteners, powder driven fasteners, power driven fasteners, or the like, such as screws, bolts, pins, rivets, or the like), welds (e.g., at different locations in the sidelap 30), and/or any type of interference connection between the material of the proximal edge 10, the distal edge 20, and/or another piece of material (e.g., forming tabs, or the like). The dovetail sidelap 30 of the present disclosure results in improved strength at the sidelap, and as such, allows for different spacing of the couplings 50 or thicknesses of the panels in order to achieve the same shear strength of traditional sidelaps used in dovetail decking systems. As such, the couplings 50 may be installed along the dovetail sidelap 30 at strategic distances from adjacent couplings 50 (e.g., in series, in parallel, staggered, and/or the like). As depicted in FIG. 5, couplings may be installed at a predetermined distance "X" from each other. The value of "X", may range from 4 inches to 60 inches along the sidelap 30 based on the material thickness of the panels 2, the desired strength (e.g., shear strength, bending strength, and/or stiffness) of the structural dovetail decking system 1, the type of couplings 50 being formed (e.g., type of fasteners, weld, type of cut connection, or the like), or other like factors. However, the range of the distance between couplings 50 may be within the stated range, fall outside of the stated range, or overlap the stated range. The couplings may be installed using a generally uniform distance from each other, such that the distance "X" described may vary slightly, or may change over different locations on the sidelap 30 depending on the requirements of each structural dovetail decking system 1. As such, the number of couplings 50 and the locations of the couplings 50 may vary within a panel length, between different panels, between different support members, or in different zones throughout the structural dovetail decking system 1 and/or building thereof. Installing couplings 50 in an optimal pattern along the dovetail sidelap 30 may be based on a balance between the desired stability and shear strength of the structural dovetail decking system 1, the flexibility of the structural dovetail decking system 1, and/or the installation time of the structural dovetail decking system.

Creating couplings in the dovetail sidelap 30 of the structural dovetail decking system 1 described herein improves the out-of-plane strength (e.g., bending strength, stiffness, or the like) and/or the shear strength of the dovetail sidelap 30 and/or structural dovetail decking system 1 over traditional dovetail decking sidelaps that do not include full top flanges, a proximal arm 18, and/or a distal arm 28. For example, the full top flanges, the use of additional couplings, or the like provide the improve strength. In particular, the full top flanges allow for more welds to be used (e.g., both corners of the sidelap 30, or the like), or allow for more fasteners (e.g., screws, or the like) in two or more rows (e.g., aligned in two or more rows, staggered between the two or more rows, or the like). As such, because of the improved shear strength in the dovetail sidelap 30 of the present invention, thinner material thicknesses may be used for the panels 2 and/or fewer couplings 50 are needed to create a structural panel system that has a shear strength that is the same as or similar to the shear strength of traditional structural systems that simply have flanges that overlap (e.g., one or more partial flanges that only partially overlap). As such, using structural dovetail decking systems 1 with the dovetail sidelap 30 described herein may result in structural dovetail decking systems that cost less due to reduced material costs (e.g., reduced price for thinner steel structural decking panels, or the like) and due to reduced assembly costs (e.g., assembly time is reduced due to less couplings, or the like) over other traditional dovetail decking systems.

Figure 6A:
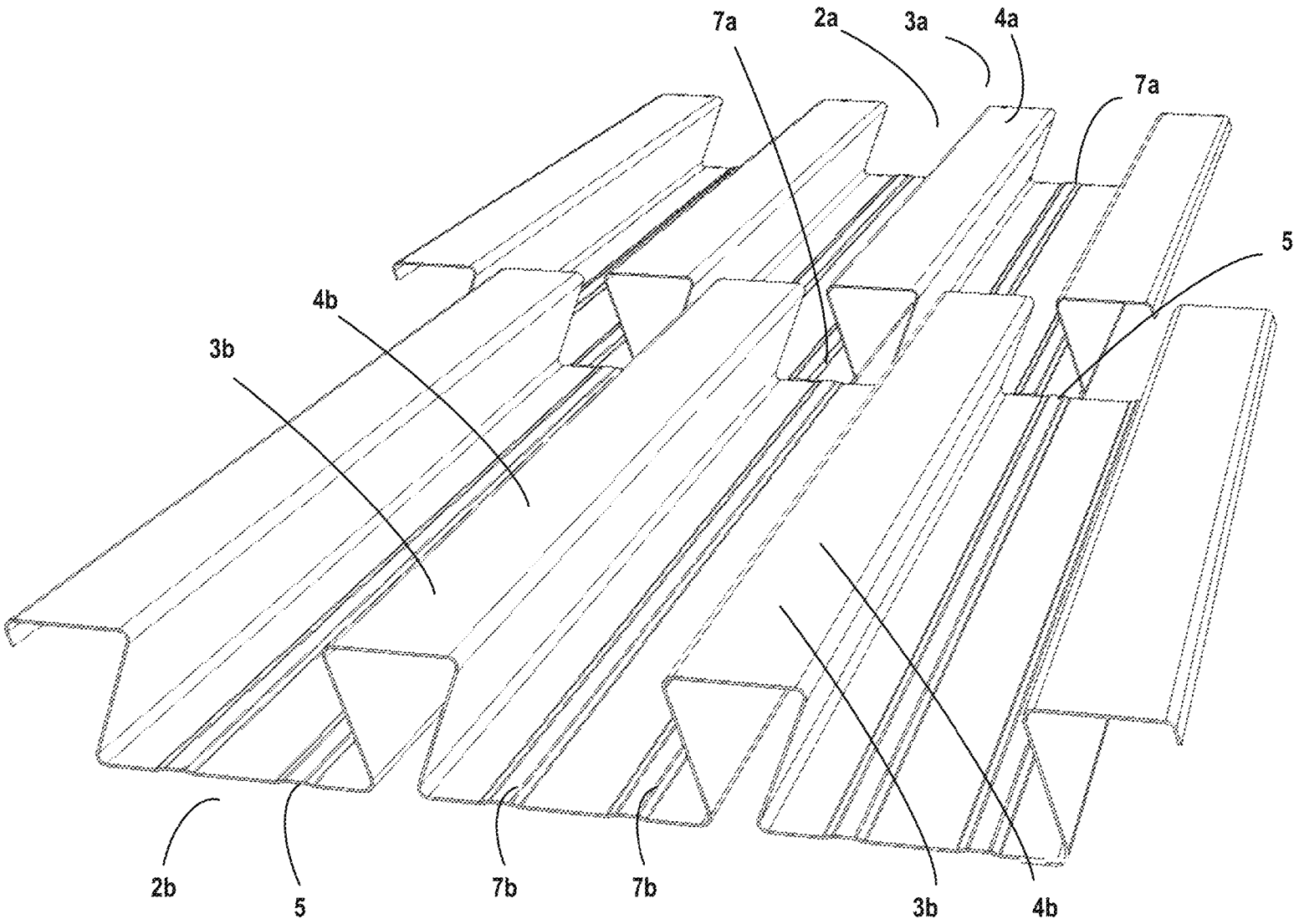
FIG. 6A illustrates a perspective view of a dovetail decking system when the decking is offset at a support member, in accordance with embodiments of the present disclosure.
Figure 6B:
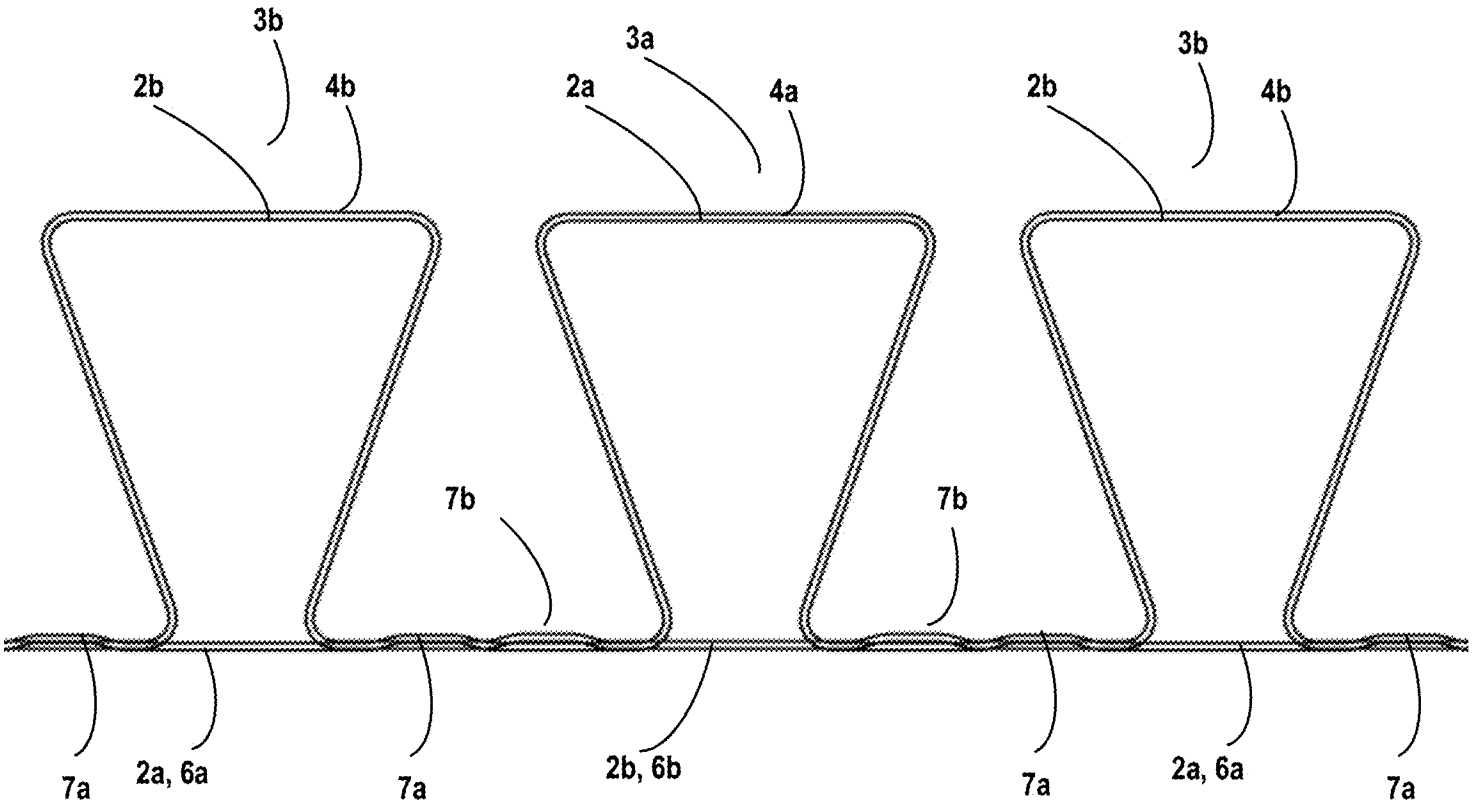
FIG. 6B illustrates an end view of the dovetail decking system of FIG. 6A, in accordance with embodiments of the present disclosure.

FIGS. 6A and 6B illustrate embodiments of the invention when panel ends 5 meet at one or more support members 210 (e.g., a wall, a girder between columns, or the like). In some embodiments, longitudinal panels 2, such as a first dovetail decking panel 2*a* and a second dovetail decking panel 2*b* that meet at the ends 5 at a support member may be offset from one another. It should be understood that the first flutes 3*a* of the first dovetail decking panel 2*a* and the second flutes 3*b* of the second dovetail decking panel 2*b* may be offset by any amount; however, in the illustrated embodiments the first flutes 3*a* and the second flutes 3*b* are offset by one-half of the spacing (e.g., pitch which is the distance between the center of adjacent top flanges 4) between the flutes 3*a*, 3*b*. As such, the first flutes 3*a* may align with the center of the spacing between the second flutes 3*b*. The offset between longitudinal panels 2 at support members may be used to aid in passing fire rating (or other) tests and/or providing the desired fire rating for the dovetail decking system 1. That is, the panels 2 may be offset at the ends 5 (and end closures are used to block the cavities in the decking) to restrict fire, smoke, steam, gases, or the like between adjacent rooms. For example, the offset aids in restricting the passages through which fire, smoke, steam, gases, or the like may pass.

It should be understood that the rib configuration of the ribs 7 in the bottom flanges 6 also aids in restricting fire, smoke, steam, gases, or the like through the ribs 7. As illustrated in FIGS. 6A and 6B, the one or more first ribs 7*a* (e.g., two ribs in each of the first bottom flanges 6*a*) of a first dovetail decking panel 2*a* and the one or more second ribs 7*b* (e.g., two ribs in each of the second bottom flanges 6*a*) of a second dovetail decking panel 2*a* also do not align when the first flutes 3*a* and second flutes 3*b* are offset (e.g., offset one-half of the spacing between flutes, or offset another distance). In traditional decking, the ribs are located in the center of the spacing between the flutes or multiple ribs are used and located such that when the flutes are offset, at least a portion of the ribs 7 align and create a passage through which fire, smoke, steam, gas, or the like may pass (e.g., between opposite sides of a wall). As such, in traditional decking the ribs must be blocked (e.g., swaged, crimped, deformed, or the like) at the ends 5 of the panels 2 in order to meet fire rating tests, which increases the costs and time associated with forming and/or assembling the decking systems 1. The ribs 7 of the decking panels 2 of the decking system 1 described herein that are offset when the panels 2 are offset provides improved safety with respect to safety ratings (e.g., fire ratings, or the like).

Moreover, since the ribs 7 are not located in the center of the bottom flanges 6, the center of the bottom flange 6 may be used for couplings 50 (e.g., fasteners, or the like) to secure the panels 2 to the joists (or other support members) and/or to provide shear fasteners for concrete poured over the decking. By locating the couplings 50 in the center of the bottom flange 6, the strength of the decking system 1 is optimized (e.g., as opposed to locating the couplings 50 off-center in traditional applications), and as such, the number of couplings 50 needed between the bottom flange 6 of a decking panel 2 and a joist 220 or other support member 210 may be reduced.

Figure 7:
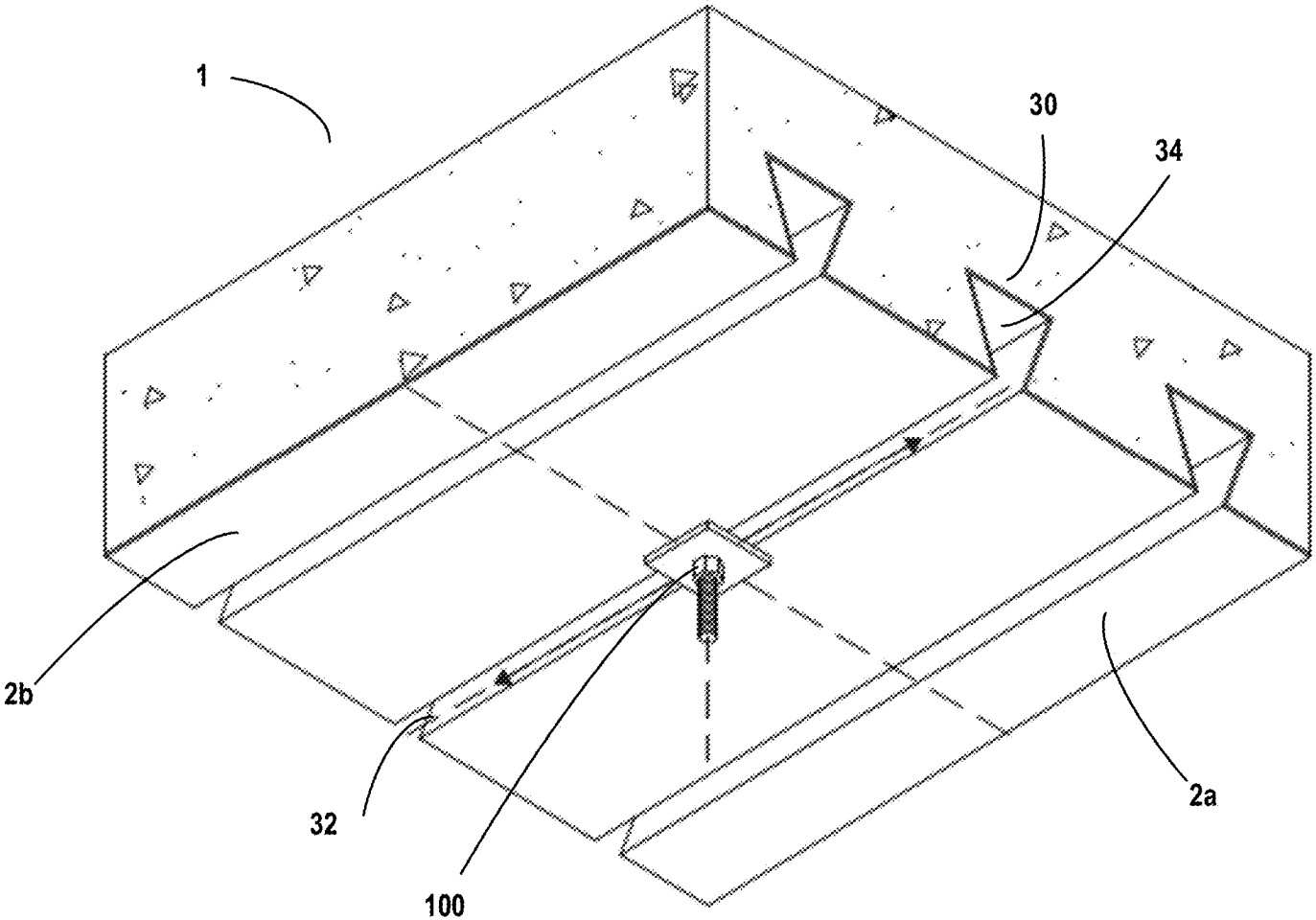
FIG. 7 illustrates a perspective view of dovetail decking being utilized for floor decking with concrete and an anchor installed, in accordance with embodiments of the present disclosure.

FIGS. 7 through 9C illustrate embodiments in which an anchor 100 is installed into the structural dovetail decking system 1 in order to hang components from the anchor 100. While particular anchors are illustrated in the figures, it should be understood that any type of anchor may be installed in the decking system 1, and in particular in the sidelap 30 of two adjacent decking panels 2, as previously described herein. As illustrated in FIG. 7, an anchor 100 may be placed through a dovetail opening and into a dovetail cavity formed by the flute of the dovetail decking. Dovetail anchors 100 are typically only placed within a fluted dovetail opening 42 and into a fluted cavity 44 that is formed into the panels 2 because in traditional dovetail decking systems 1 the dimensions of the opening and cavity at the sidelap cannot be maintained consistently. As such, anchors 100 may not fit into the openings and/or cavities at traditional sidelaps (e.g., the openings and/or cavities are too large or too small) and/or the anchors 100 may not operate or meet listed specifications when they are used within an opening and cavity of traditional sidelaps. However, unlike traditional sidelaps, the dovetail sidelap 30 described herein is able to form a dovetail sidelap opening 32 and dovetail cavity 34 with dimensions that are consistent with dimensions of the dovetail flute opening 42 and the dovetail flute cavity 44.

Figure 8A:
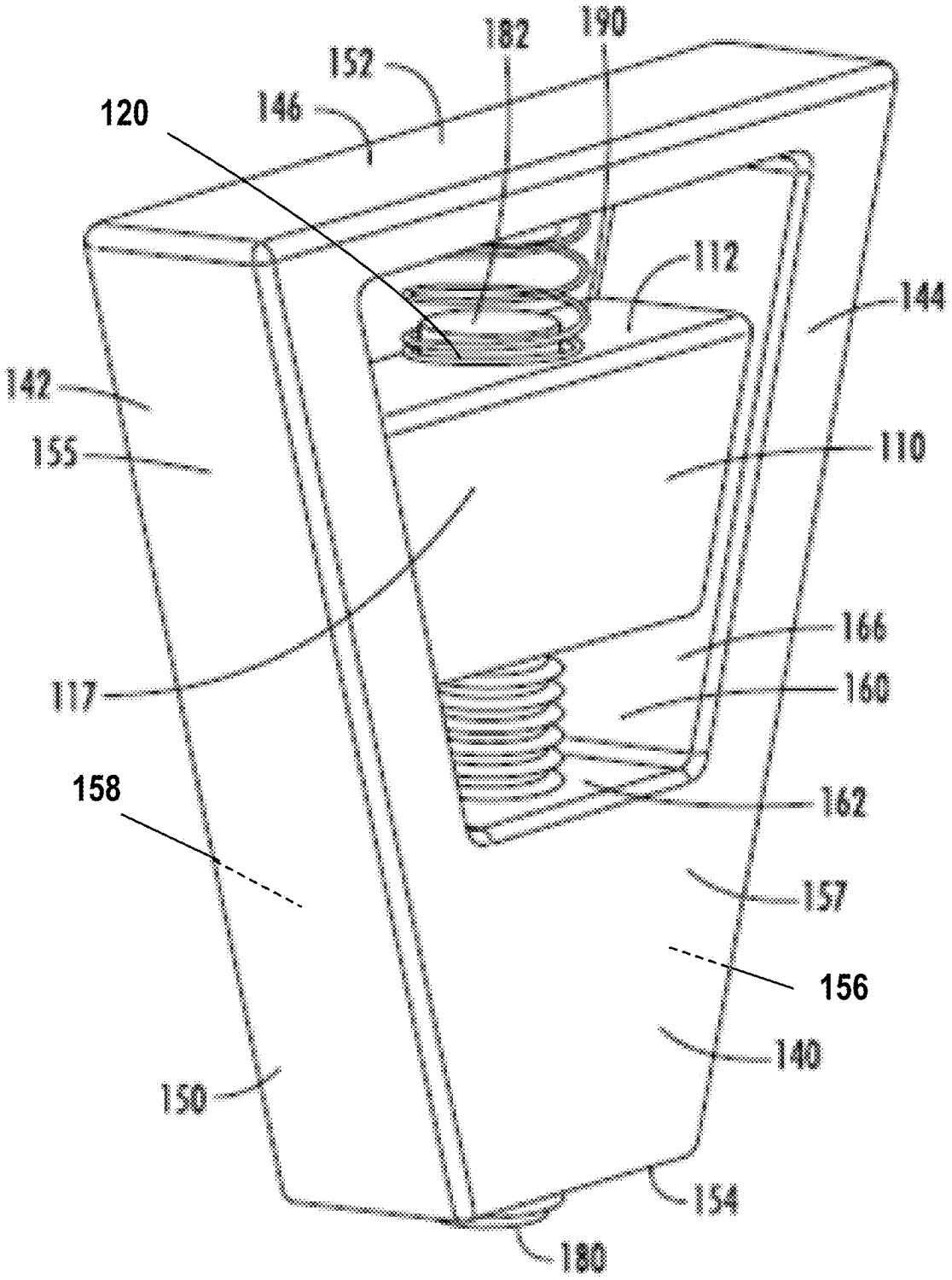
FIG. 8A illustrates a perspective view of a dovetail decking anchor in an assembly configuration before or as it is being installed in dovetail decking, in accordance with embodiments of the present disclosure.
Figure 8B:
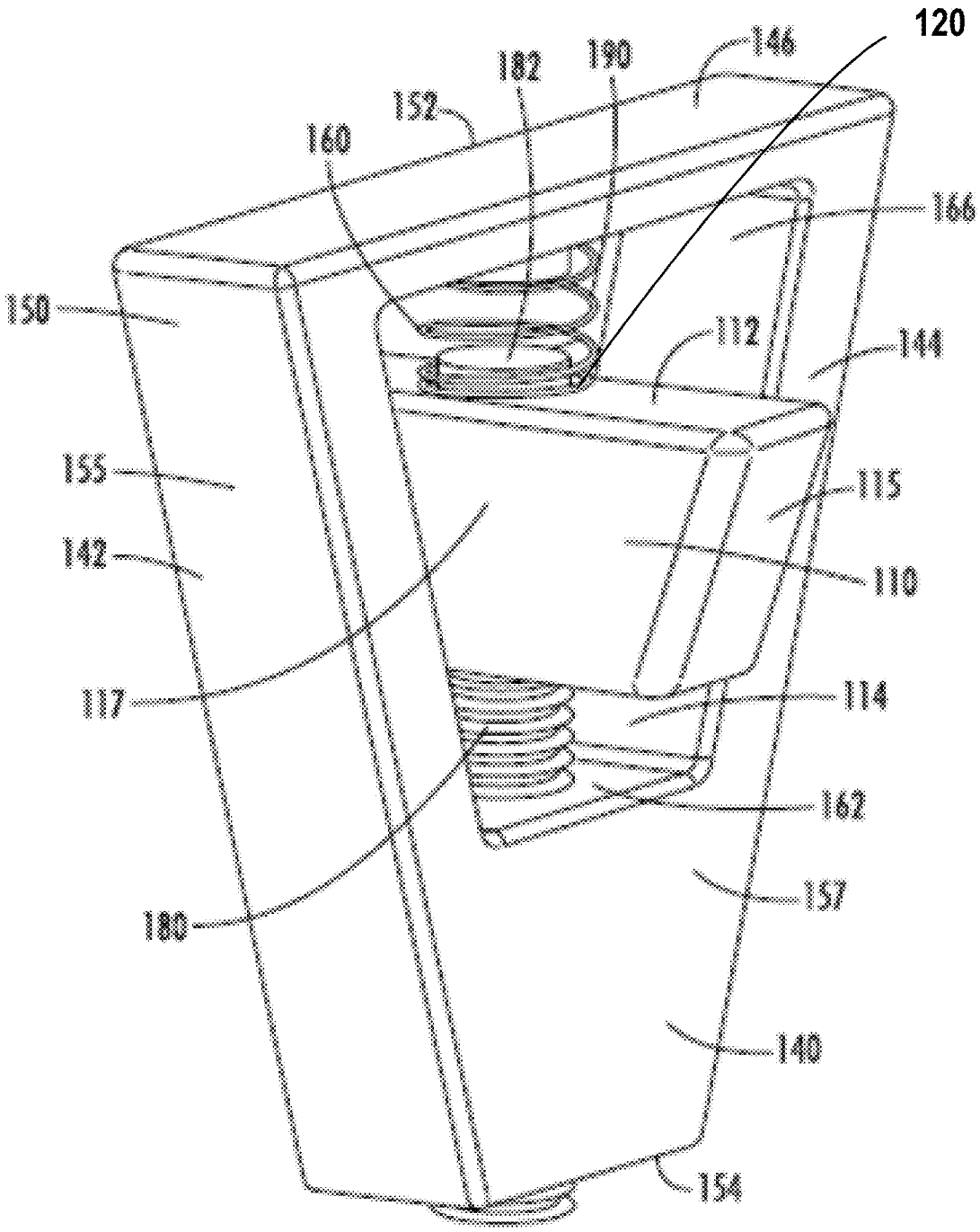
FIG. 8B illustrates a perspective view of a dovetail decking anchor in an installed configuration as it would be installed in dovetail decking, in accordance with embodiments of the present disclosure.
Figure 8C:
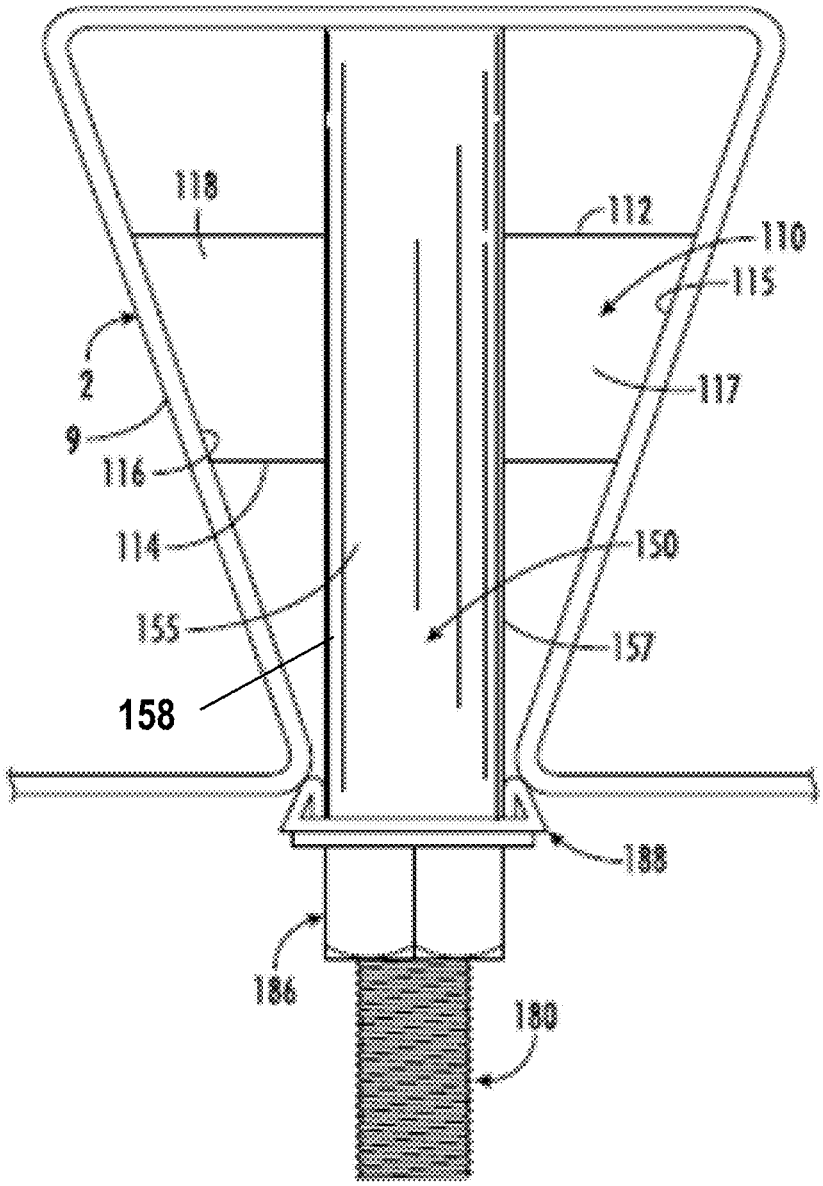
FIG. 8C illustrates an end view of a dovetail decking anchor as installed within dovetail decking, in accordance with embodiments of the present disclosure.
Figure 9A:
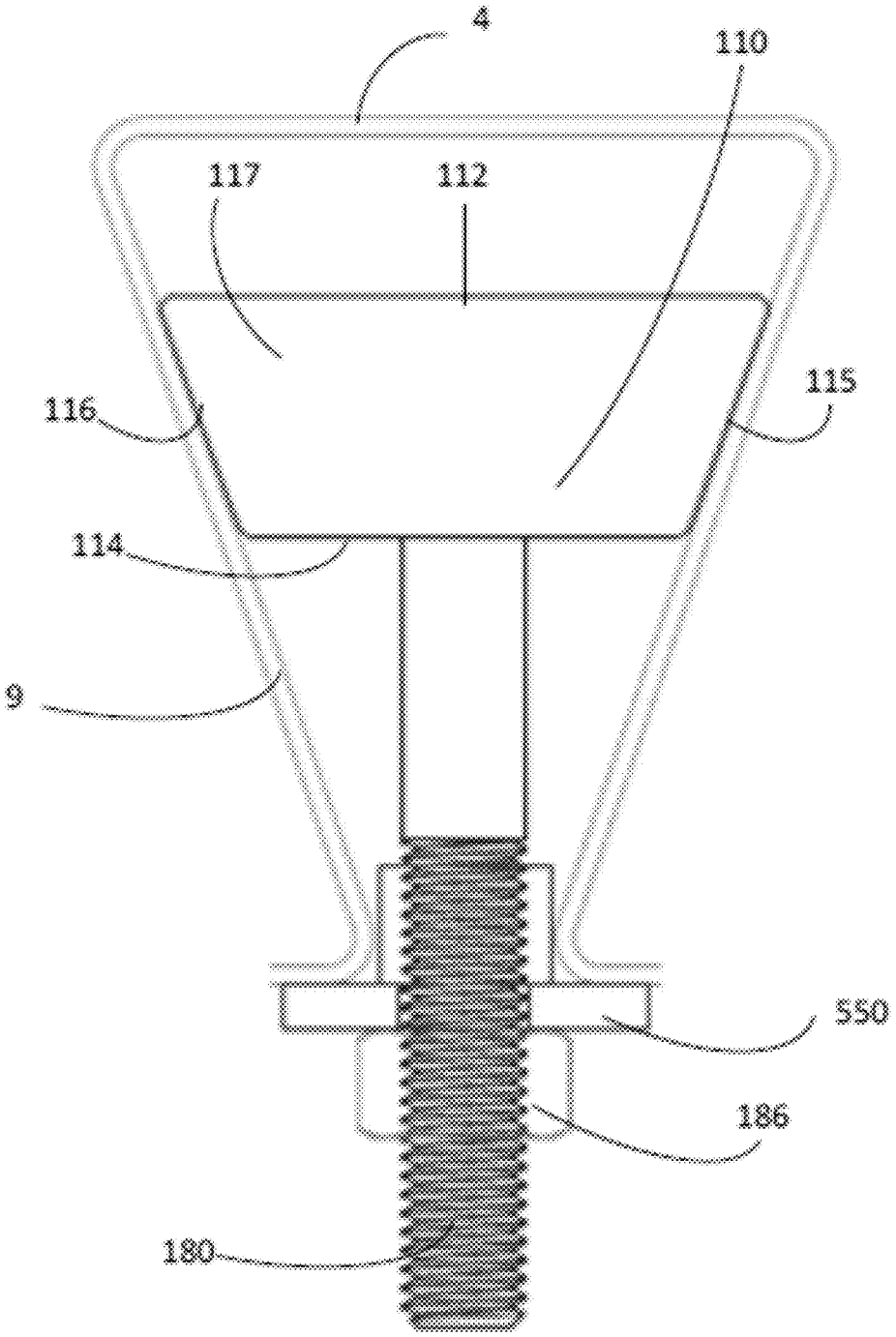
FIG. 9A illustrates a cross-sectional end view of an alternate dovetail decking anchor installed within dovetail decking, in accordance with embodiments of the present disclosure.
Figure 9D:
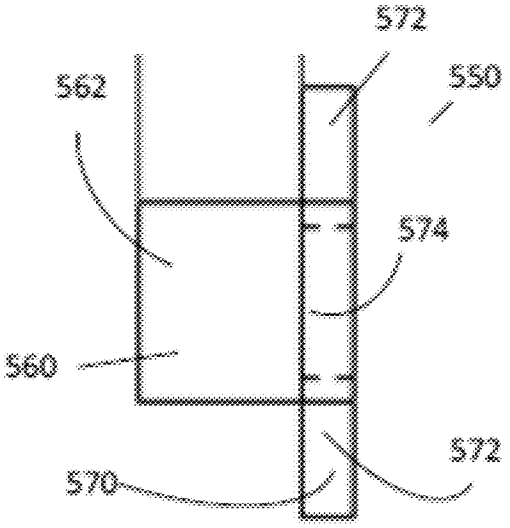
FIG. 9D illustrates a side view of a portion of the anchor of FIG. 9A, in accordance with some embodiments of the present disclosure.
Figure 9B:
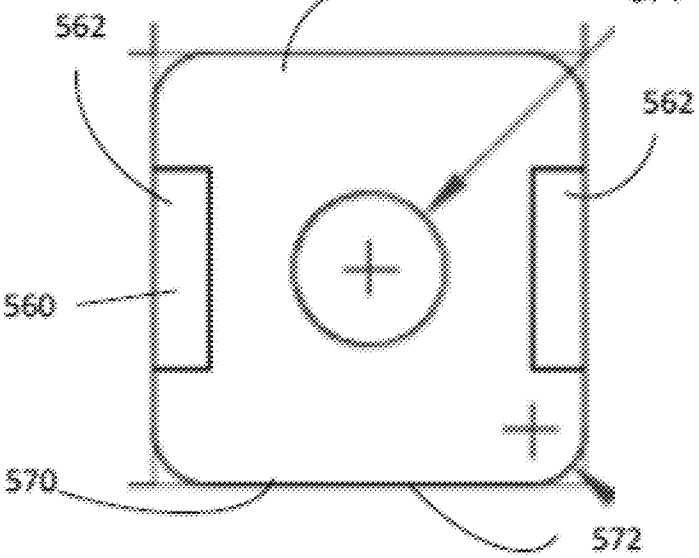
FIG. 9B illustrates a top view of a portion of the anchor of FIG. 9A, in accordance with some embodiments of the present disclosure.
Figure 9C:
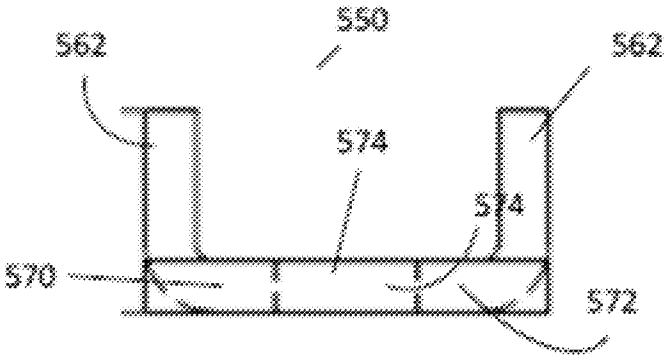
FIG. 9C illustrates a side view of a portion of the anchor of FIG. 9A, in accordance with some embodiments of the present disclosure.

It should be understood that any type of anchor may be utilized with the dovetail decking system 1, including within the dovetail sidelap 30, such as any type of wedge anchor and/or other type of anchor, including the anchors described in U.S. Published Patent Application Number 2020/0354972 entitled "Decking Anchor, Decking System Utilizing the Decking Anchor, and Methods of Installing the Decking Anchor," and U.S. Published Patent Application Number 2021/0198899 entitled "Decking Anchor, Decking System Utilizing the Decking Anchor, and Method of Installing the Decking Anchor," the entirety of both applications are hereby incorporated by reference. As such, in some embodiments the decking anchor may be a dovetail decking anchor 100, as illustrated in FIGS. 8A through 8C, in which a first anchor portion 110 (e.g., a web anchor) is located within a second anchor portion 150 (e.g., a flange anchor having a closed flange anchor aperture 160 as illustrated, or an open flange anchor aperture 160, not illustrated). Alternatively, or additionally, FIGS. 9A through 9C illustrate alternate embodiments of an anchor 500 that may be used within a decking anchor system 50.

As illustrated in FIGS. 8A through 8C, the first anchor portion 110 (e.g., a web anchor) and a second anchor portion 150 (e.g., flange anchor) are illustrated. It should be understood that the web anchor 110 and the flange anchor 150 may be operatively coupled to each other, but move independently with respect to each other, as will be discussed throughout the specification. It should be further understood that during assembly the web anchor 110 and the flange anchor 150 may be in an assembly position that allows the anchor 100 to be inserted into a cavity 34, 44 of the dovetail decking panels 2. A portion of the flange anchor 150 engages a portion of the flute 3 (e.g., inside surface of the top flange 4) of the dovetail decking panel 2, and thereafter, the web anchor 110 may be rotated with respect to the flange anchor 150 (e.g., approximately 90 degrees). In some embodiments, the rotation of the web anchor 110 may occur after being further extended into the dovetail cavity 34, 44 of the dovetail decking panel 2. After being rotated, the web anchor 110 engages the webs 9 of the decking 2, such as with the aid of a biasing member, as will be discussed in further detail herein.

It should be understood that the web anchor 110 may comprise a wedge nut of any shape and/or size. For example, the web anchor 110 may be a trapezoid shape and/or any other type of uniform or non-uniform shape. In some embodiments, the web anchor 110 may comprise a top web anchor surface 112, a lower web anchor surface 114, opposing web anchor contacting surfaces 115, 116 (e.g., a first web anchor contacting surface 115 and a second web anchor contacting surface 116), and opposing web anchor free surfaces 117, 118 (a first web anchor free surface 117, and a second web anchor free surface 118). In some embodiments the web anchor 110 may have one or more web anchor apertures 120. The one or more web anchor apertures 120 may extend partially or completely through the web anchor 110, such as partially into the top web anchor surface 112, the lower web anchor surface 114, or from the top web anchor surface 112 through lower web anchor surface 114. It should be further understood that the surfaces described herein 112, 114, 115, 116, 117, 118 of the web anchor 110 may be planar surfaces or may have another shape, such as a convex, concave, non-uniform, or other like shape. It should be further understood that the surfaces may be continuous and/or discontinuous, and as such, may have surfaces that are formed from projections within and/or extending from the surfaces illustrated in the figures. As such, the opposing web anchor contacting surfaces 115, 116 and the opposing web anchor free surfaces 117, 118 may extend between the top web anchor surface 112 and the lower web anchor surface 114, as illustrated in FIGS. 8A through 8B, or may not extend continuously between the top web anchor surface 112 and the lower web anchor surface 114 (not illustrated).

The flange anchor 150 may comprise a flange base 140, a first flange support 142, and a second flange support 144 extending from the flange base 140. In some embodiments, the first support 142 and the second support 144 may be operatively coupled together through the use of a flange bridge 146. As such, the flange anchor 150 may comprise one or more top flange anchor surfaces 152, one or more lower flange anchor surfaces 154, one or more flange anchor sides (e.g., opposing first and second flange anchor sides 155, 156, and opposing third and fourth flange anchor sides 157, 158). The one or more top flange anchor surfaces 152, as illustrated in FIGS. 8A through 8C, may comprise a single surface (or multiple surfaces) that extends between the first and second flange anchor sides 155, 156. The flange anchor 150 may have a flange anchor aperture 160. In some embodiments, the flange anchor aperture 160 may be formed by the flange base 140, the first flange support 142, and the second flange support 144, and/or the flange bridge 146. Moreover, the flange aperture 150 may comprise one or more flange anchor aperture surfaces (e.g., a lower flange aperture surface 162, a top flange aperture surface 164, and first and second opposing flange aperture surfaces 166, 168). The flange anchor aperture 160 may receive and house the web anchor 110 and allow and/or prevent movement between the web anchor 110 and the flange anchor 150 (e.g., vertical—up and down, and rotational). The flange anchor 150 may further comprise a flange fastener aperture 170.

As illustrated in FIGS. 8A through 8C, the anchor 100 may further comprise a fastener 180 with a first end 182 (e.g., proximate end) and a second end 184 (e.g., a distal end), a stop 186 (e.g., a nut, or the like), a washer 188, and/or a biasing member 190 (e.g., a spring, or the like). It should be understood that the web anchor 110 may be operatively coupled to the flange anchor 150, such that the web anchor 110 is received within at least a portion of the flange anchor 150 (e.g., the flange anchor aperture 160). In some embodiments, a first end 182 of the fastener 180 may be removably operatively coupled to the web anchor 110, such as threaded into a web anchor aperture 120, inserted through the web anchor aperture 120 and secured (e.g., through a nut, the biasing member 190, or the like), and/or secured through any other type of coupling. In other embodiments, as will be discussed in further detail herein, the fastener 180 may be made permanently operatively coupled to the web anchor 110 such as through welding, brazing, press-fitting, or the like, and/or machined into web anchor 110. It should be further understood that the fastener 180 may be any type of member, such as but not limited to a rod, screw, bolt, rivet, or the like of any shape, such as circular, oval, square, any polygonal shape, or the like.

The dovetail anchor 100 illustrated in FIGS. 8A through 8C may be adjustable, such that at least a portion of the anchor 110 may be positioned in two or more orientations. For example, in a first position (e.g., an assembly position as illustrated in FIG. 8A) at least a portion of the opposing web anchor 110 contacting surfaces 115, 116 (or the entire surfaces) may contact a portion of the one or more flange aperture surfaces, such as a second flange aperture surface 166 and a third flange aperture surface 168. The lower web anchor surface 114 may or may not contact the first flange aperture surface 162. Should the lower web anchor surface 114 contact the first flange aperture surface 162, at least a portion of the surfaces may contact or all of the surfaces may contact each other. Moreover, it should be understood that in the first position, the opposing web anchor free surfaces 117, 118 may (as shown in FIG. 8A) or may not be parallel and in plane with the third and fourth opposing flange anchor sides 157, 158. During assembly of the anchor 100 with the decking 2, the anchor 100 is inserted into a cavity 34, 44 of the decking 2. For example, the anchor 100 may be inserted into the cavity 34, 44 such that the opposing web anchor free surfaces 117, 118 and the third and fourth opposing flange anchor sides 157, 158 run longitudinally along with the cavity 34, 44 of the decking panels 2. The anchor 100 is inserted into the cavity 34, 44 until the one or more top flange anchor surfaces 152 contact a surface of the top flange 4 (e.g., internal surface of the top flange 4) of a flute 3 or sidelap 30 of the dovetail decking panel 2. Once the one or more top flange anchor surfaces 152 contact the top flange 4, the biasing member 190 allows the web anchor 110 to move vertically with respect to the flange anchor 150. That is, the flange anchor 150 remains stationary, while the web anchor 110 continues to move towards the top flange 4 of the dovetail decking panel 2, as a user pushes on the fastener 180. In this way, the one or more web anchor 110 surfaces (e.g., the opposing web anchor free surfaces 117, 118, and in some embodiments the lower web anchor surface 114) separate from the one or more aperture surfaces (e.g., the opposing first and second flange aperture side surfaces 166, 168, and in some embodiments the lower flange aperture surface 162).

Once the web anchor 110 is separated from contact with the flange anchor 150 (e.g., the one or more web anchor surfaces are separated from contact with the one or more flange aperture surfaces), the web anchor 110 has the ability to rotate with respect to the flange anchor 150, while the flange anchor 150 remains stationary. For example, the opposing third and fourth flange anchor sides 157, 158 are restricted from rotating within in the cavity 34, 44 by a portion of the dovetail decking panel 2, such as a portion of the webs 9 and/or lower flanges 6 (e.g., decking corners wherein the webs 9 and/or bottom flanges 6 meet at the openings 32, 42), and/or by the contact between the top flange 4 of the dovetail decking panel 2 and the one or more top flange anchor surfaces 152. As such, the web anchor 110 may be rotated approximately ninety (90) degrees into a second position (e.g., an installed position), such that the plane of the opposing web anchor free surfaces 117, 118 are perpendicular with the plane of the third and fourth opposing flange anchor sides 157, 158, as illustrated in FIG. 8C.

It should be further understood that in some embodiments, a biasing member 190 may be used to bias the web anchor 110 against the flange anchor 150 (e.g., against the first and second flange aperture side surfaces 166, 168) in the assembly position as illustrated in FIG. 8A, and/or against the webs 9 of the decking 2 in the installed position as illustrated in FIG. 8C. Alternatively, or additionally, an installer may utilize a stop 186, such as a nut or other like feature to install the anchor 100. For example, an installer may utilize the stop to draw the web anchor 110 lower vertically while the flange anchor 150 remains stationary. That is, for example, as the nut is rotated (e.g., clockwise), the nut will move up the fastener, engage the lower flange surface 154 or a component there between (e.g., a washer 188, or the like), then through continued rotation the fastener 180 will be moved vertically downward, which draws the web anchor 110 downward. The stop 186 is used until at least a portion of (or all of) the opposing web contacting surfaces 115, 116 contact the interior surfaces of the webs 9 within the cavity 12 of the dovetail decking panel 2, for example, as illustrated in FIG. 8C. As such, the fastener 180 and the stop 186 are used to bias the web anchor 110 with respect to the flange anchor 150, the web anchor 110 against the webs 9, and the flange anchor 150 against the internal surface of the top flange 4 of the dovetail decking panel 2.

While FIGS. 8A through 8C illustrate some embodiments of the anchor 100, it should be understood that different embodiments of the anchor 100 are discussed herein, in which the flange anchor 150 may not have an enclosed flange aperture 160 (e.g., no top flange bridge), may have two or more top flange anchor surfaces 152, may have a biasing member 190 located in different locations of the anchor 100, may not have a biasing member 190, may have multiple hanging locations in the flange anchor 150, may have a fastener 180 that is integral with the web anchor 110, or the like.

FIGS. 9A through 9D illustrate alternate embodiments of the anchor 100. As illustrated in FIGS. 9A through 9D, the flange anchor 550 may be separate from the web anchor 110. The flange anchor 550 may have an top portion 560 and a lower portion 570. The top portion 560 may comprise one or more protrusions 562. It should be understood that the top portion 560 of the flange anchor 550 may be inserted into the cavity 34, 44 of the dovetail decking panel 2 through the openings 32, 42. Alternatively, the lower portion 570, may comprise a plate 572 that remains outside of the cavity 34, 44 of the dovetail decking panel 2, and may further be operatively coupled with the one or more bottom flanges 6 of the dovetail decking panel 2. As such, it should be understood, as illustrated in FIGS. 9A through 9D, the top portion 560 of the flange anchor 550, such as the one or more protrusions 562 may be utilized to aid is securing the web anchor 110 in place when installed. It should be understood that the flange anchor 550 is not utilized to orientate the web anchor 110 (which the web anchor 110 does itself based on the width of the web anchor 110), but to provide additional resistance for loading of the anchor 100. For example, the top portion 560, such as the one or more protrusions 562, and/or the plate 572 may be used to provide loading resistance transverse to the longitudinal axis of the flute 3 of the dovetail decking panel 2, and in some embodiments may provide for some loading resistance in the longitudinal direction of the flute 3. Typically, the web anchor 110 by itself may provide loading resistance transverse to the longitudinal axis of the flute 3, but when combined with the flange anchor 550 the loading resistance transverse to the longitudinal axis of the flute 3 may be improved (e.g., it provides additional loading resistance at the opening of the flute 3). Moreover, the web anchor 110 does not typically provide loading resistance along the longitudinal direction of the flute 3 (except for some frictional resistance of the contact with the webs 9). In some embodiments, the flange anchor 550 may provide some additional resistance to longitudinal loading by the plate 572 acting against the lower flange 6 of the dovetail decking panel 2 and/or providing some additional frictional resistance with the contact with the lower flange 6. Moreover, plate 572 may also provide resistance in other directions because of the contact with the lower flange 6 surfaces of the dovetail decking panel 2.

It should be further understood that the anchor 100 may use a stop 186 and fastener 180 (integral with the web anchor 110, as illustrated, or as a separate component) that operatively couples the web anchor 110 and the flange anchor 550. The contact of the web anchor 110 contacting surfaces 115, 116 with the webs 9 and the use of the flange anchor 550 and stop 186 (e.g., pulling down on the web anchor 110 against the webs 9) aids in preventing rotation of the anchor 100 within the cavity 12 of the decking in response to loading (e.g., torsional loading).

Figure 10A:
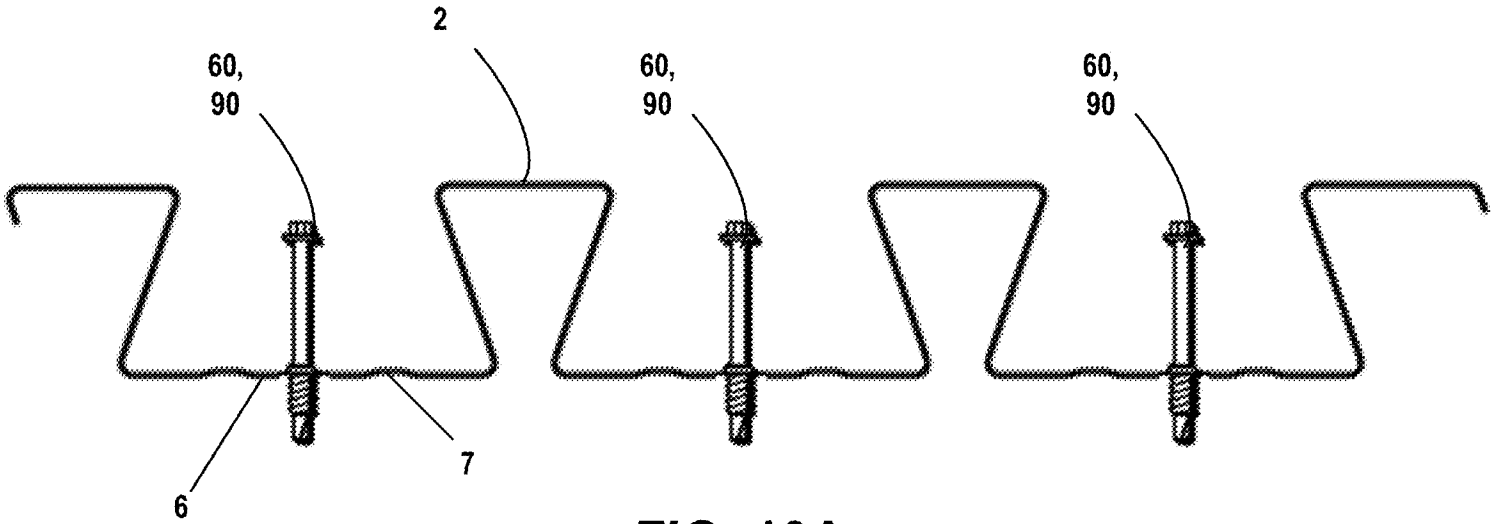
FIG. 10A illustrates an end view of a portion of the structural dovetail decking panel with fasteners, in accordance with some embodiments of the present disclosure.

As previously described herein, as illustrated in FIG. 10A, in the event that shear fasteners 60 (e.g., such as welded shear studs, stand-off fasteners, or the like) are used, the shear fasteners 60 may be operatively coupled in one or more of the bottom flanges 6 (e.g., between ribs 7 in the center of the bottom flanges, or the like) to provide additional strength to the dovetail decking system 1. As such, in some embodiments concrete may be poured over the dovetail decking panels 2 with the stand-off fasteners 400 and the stand-off fasteners 400 aid in transferring loads through the decking panels 2 and into the support members 210.

Figure 10B:
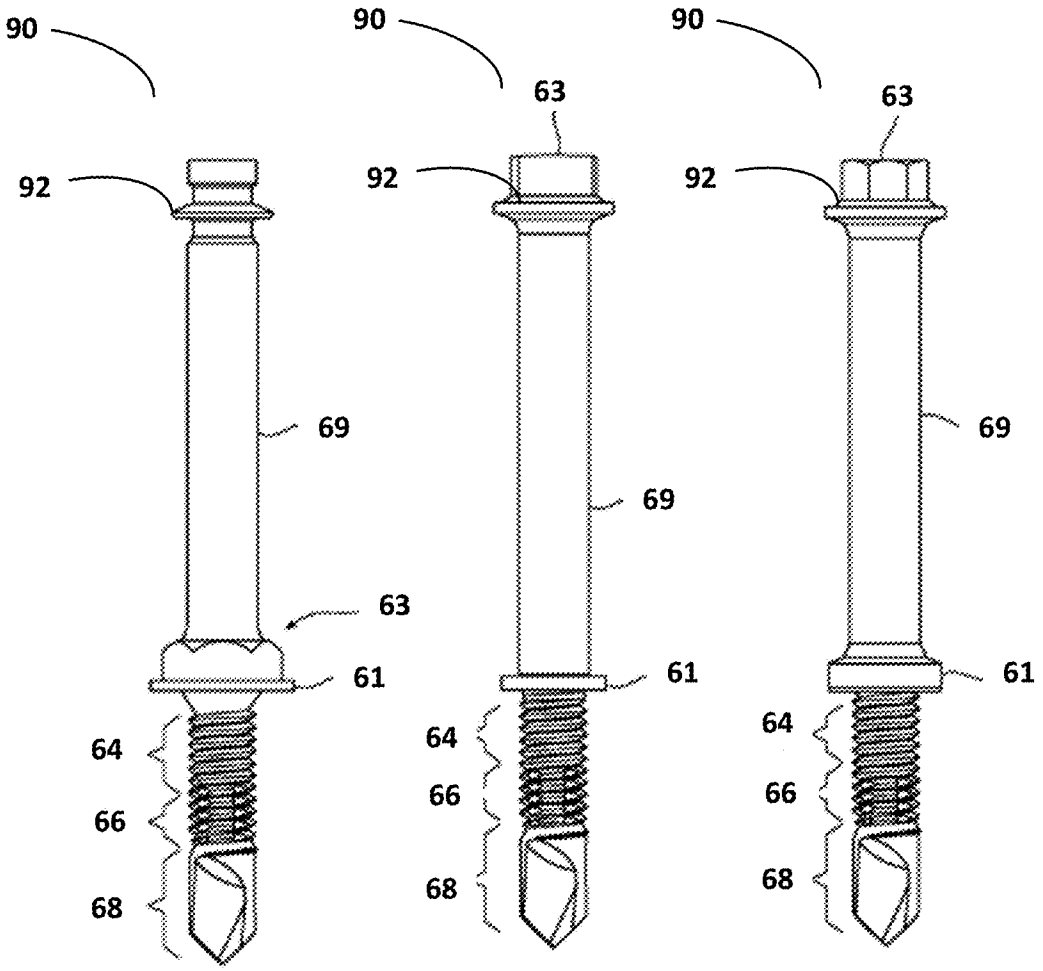
FIG. 10B illustrated example embodiments of stand-off fasteners, in accordance with some embodiments of the present disclosure.

The shear fasteners 60 may be welded shear studs (e.g., welded anchors, welded connectors, or the like), for example, as described in the AISC specification for steel buildings. However, in some embodiments, the shear fasteners 60 may be self-drilling, thread-forming stand-off screws 90, as shown in FIG. 10B. The shear fasteners 60 typically have a major diameter between about 0.12 inch and about ⅜ inch. The self-drilling, thread-forming stand-off screws may include the head 63, a stand-off portion 69 having a desired length, a seat portion 61, the threaded portion 64 adjacent the seat portion 61, and the thread-forming portion 66 adjacent the threaded portion 64 adapted to enable the fastener to engage with formed threads in a building member. The seat portion 61 may be a SEMS washer positioned adjacent the stand-off portion 69. A SEMS washer includes a washer or other member held captive on the fastener where the dimension of the fastener on each side of the SEMS washer being larger than the washer hole prevents the SEMS washer from coming off. Alternatively, the seat portion 61 may be a flange integral to the stand-off portion 69. In yet another alternative, the seat portion 61 of the self-drilling, thread-forming stand-off screws 90 may include the head 63. As shown in FIG. 10B, the self-drilling, thread-forming stand-off screws 90 may include an anchor member 92 formed integrally with the stand-off portion 69. The anchor member 92 may be a rolled collar. As previously discussed, the location of the ribs 7, provides an improved location for the attachment of couplings 50, such as fasteners, and in particular the shear fasteners 60, including the self-drilling, thread-forming stand-off screws 90, described herein.

Figure 11:
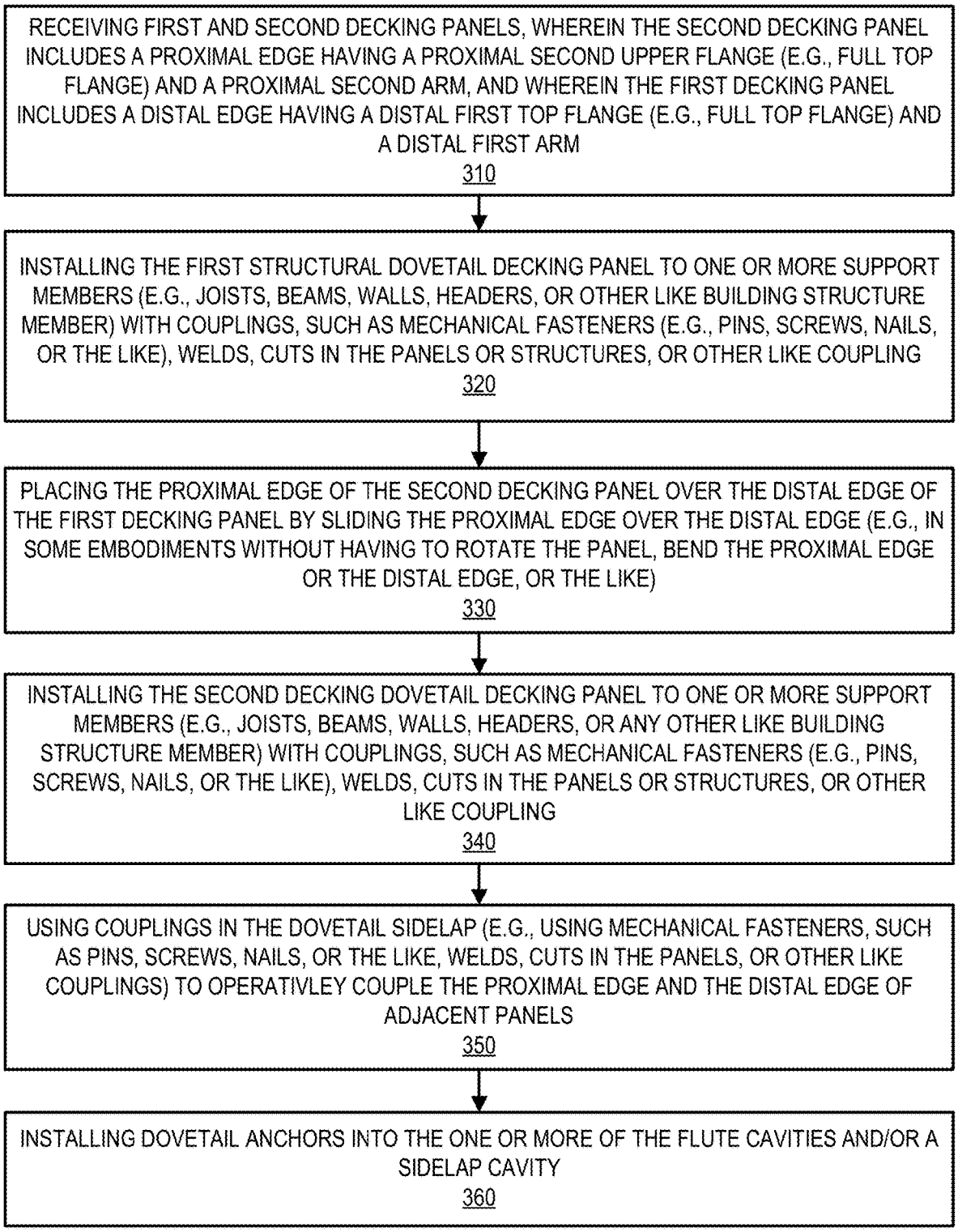
FIG. 11 illustrates a process flow for assembling structural dovetail decking panels into a dovetail decking system, in accordance with embodiments of the present disclosure.

FIG. 11 is a process flow 300 for forming a dovetail decking system 1, including assembling steel structural panels 2 together. Block 310 of FIG. 11 indicates that the process includes receiving first and second structural dovetail decking panels 2. The second structural dovetail decking panel 2*b* includes a proximal edge 10 having a proximal top flange 16 (e.g., a full top flange 4) and a proximal arm 18 extending outwardly away from the second structural dovetail decking panel 2*b*. The first structural dovetail decking panel 2*a* includes a distal edge 20 having a distal top flange 26 (e.g., a full top flange 4) and a distal arm 28 extending inwardly toward the first structural dovetail decking panel 2*a*. Receiving the first and second structural dovetail decking panels 2 may include manufacturing (e.g., by rolling, bending, or the like), receiving on a site, selecting for installation on a building, or the like).

FIG. 11 further illustrates in block 320 that the first structural decking panel 2 is operatively coupled to the building structure using support member couplings, such as to one or more support members (e.g., to joists, girders, beams, walls, headers, or any other like support member in order to form a roof, floor, and/or wall system). The couplings between the first structural dovetail decking panel 2*a* and the one or more support members 210, 220 may be mechanical fasteners, welds, cuts in the material, or other like couplings. In some embodiments of the invention, the first structural dovetail decking panel 2*a* may be operatively coupled to the one or more support members 210, 220 of the structure before, during, or after being operatively coupled to an adjacent decking panel 2, and/or before, during or after sidelap couplings 50 are formed in the sidelap 30 between adjacent panels 2.

FIG. 11 further illustrates in block 330 that a second structural dovetail decking panel 2*b* is placed (e.g., slid at an angle, slid horizontally, or the like as previously discussed herein with respect to FIGS. 3A through 4H) onto the first structural dovetail decking panel 2*a*. For example, the proximal edge 10 of the second structural decking panel 2*b* is placed over the distal edge 20 of the first structural decking panel 2*a* by sliding the proximal edge 10 over the distal edge 20 at an angle (e.g., in some embodiments without having to rotate the panel, bend the proximal edge 10 or the distal edge 20, or the like). Alternatively, or additionally, the proximal edge 10 of the second structural decking panel 2*b* is placed over the distal edge 20 of the first structural decking panel 2*a* by locating the proximal arm 18 of the proximal edge 10 on the distal top flange 26 of the distal edge 20 and sliding the proximal arm 18 horizontally over the distal top flange 26 until the proximal arm 18 is able to slide over (e.g., drop) onto the corner of the distal top flange 26 and distal web 24. As previously discussed herein, the proximal arm 18 and the distal arm 28 aid in restricting the movement of the proximal edge 10 and the distal edge 20 with respect to each other before the sidelap couplings 50 are formed in the sidelap 30.

FIG. 11 further illustrates in block 340 that the second structural decking panel 2*b* is operatively coupled to the building structure using support member couplings, such as to one or more support members (e.g., to joists, girders, beams, walls, headers, or any other like support member in order to form a roof, floor, and/or wall system). As described herein, the couplings between the second structural dovetail decking panel 2*a* and the one or more support members may be mechanical fasteners, welds, cuts in the material, or other like couplings. In some embodiments of the invention, the second structural dovetail decking panel 2*b* may be operatively coupled to the one or more support members 210, 220 of the structure before, during, or after being operatively coupled to the first structural dovetail decking panel 2*a*, and/or before, during or after sidelap couplings 50 are formed in the sidelap 30 between the first structural dovetail decking panel 2*a* and the second structural dovetail decking panel 2*b*.

Block 350 of FIG. 11 illustrates that the process further includes using couplings 50 in one or more locations on the sidelap 30 to operatively couple a proximal edge 10 to a distal edge 20 at a sidelap 30 of adjacent decking panels 2. As previously discussed, the sidelap couplings 50 may be created by inserting a self-drilling screw (or other like fastener discussed herein) into the dovetail sidelap 30, welding the sidelap 30, or cutting substantially through the dovetail sidelap 30 at the one or more locations. In some embodiments of the invention, the spacing of the sidelap couplings 50 in the sidelap 30 are positioned to create the desired shear strength in the assembled structural dovetail decking system 1 based at least in part on the requirements of the building, the type of couplings used, the thickness of the panels 2, or the like. Other structural panels 2 are added, and couplings 50 are used until the structural dovetail decking system 1 is complete.

Furthermore, in some embodiments of the invention, stand-off fasteners 60 (e.g., shear studs) or the like may be operatively coupled in one or more of the bottom flanges 6 (e.g., between ribs 7 in the center of the bottom flanges, or the like) to provide additional strength to the dovetail decking system 1. As such, in some embodiments concrete may be poured over the dovetail decking panels 2 (e.g., with or without the stand-off fasteners).

FIG. 11 further illustrates in block 360 that one or more dovetail decking anchors 100 are installed into one or more of the flute cavities 44 and/or one or more of the sidelap cavities 34. As previously discussed herein, unlike traditional dovetail decking systems that cannot control the dimensions of the openings and/or cavities within sidelaps, the edges 10, 20 of the present disclosure allow for the dimensions of the openings and/or cavities within the sidelaps 30 to be the same as, or substantially similar to, the dimensions of the openings and/or cavities of the flutes 3. As such, unlike traditional dovetail decking systems that cannot support anchors, the dovetail decking system 1 of the present disclosure allows for the use of anchors 100 within the sidelap opening 32 and sidelap cavity 34 of the dovetail sidelap 30.

While certain exemplary embodiments have been described and shown in the accompanying drawings, it is to be understood that such embodiments are merely illustrative of and not restrictive on the broad invention, and that this invention should not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

What is claimed is:

1. A structural dovetail panel system, comprising:

a first structural dovetail panel comprising:

a plurality of first dovetail flutes wherein each of the plurality of first dovetail flutes comprise a first top flange, portions of two first bottom flanges, and two first webs operatively coupling the first top flange to the portions of the two first bottom flanges, wherein the two first webs converge from the first top flange towards the portions of the two first bottom flanges to form a first flute cavity with a first flute opening; and a first distal edge comprising a first distal top flange;

a second structural dovetail panel comprising:

a plurality of second dovetail flutes, wherein each of the plurality of second dovetail flutes comprise a second top flange, portions of two second bottom flanges, and two second webs operatively coupling the second top flange to the portions of the two second bottom flanges, wherein the two second webs converge from the second top flange towards the portions of the two second bottom flanges to form a second flute cavity with a second flute opening; and a second proximal edge comprising a second proximal top flange and a second proximal arm extending outwardly away from the second structural dovetail panel at an obtuse internal angle with the second proximal top flange;

wherein the second proximal top flange and the second proximal arm are located over the first distal top flange to create a dovetail sidelap and a sidelap cavity with a sidelap opening;

one or more couplings formed in the dovetail sidelap for operatively coupling the first structural dovetail panel to the second structural dovetail panel.

2. The structural dovetail panel system of claim 1, wherein the second proximal top flange is operatively coupled to a second bottom flange through a second proximal web, and wherein the second proximal arm extends outwardly away from the second structural dovetail panel at a second proximal arm angle that is less than or equal to a second proximal web angle of the second proximal web with respect to a second proximal top flange plane.

3. The structural dovetail panel system of claim 2, wherein the second proximal arm has a second proximal arm length that is less than half of the length of the second proximal web.

4. The structural dovetail panel system of claim 1, wherein a first distal arm extends inwardly towards the first structural dovetail panel from the first distal edge, and wherein the second proximal top flange and the second proximal arm are located over the first distal top flange and the first distal arm.

5. The structural dovetail panel system of claim 4, wherein the second proximal top flange is operatively coupled to a second bottom flange through a second proximal web, and wherein the first distal arm extends inwardly toward the first structural dovetail panel at a first distal arm angle that is less than or equal to a second proximal web angle of the second proximal web with respect to a second proximal top flange plane.

6. The structural dovetail panel system of claim 5, wherein the first distal arm has a first distal arm length that is less than half of a length of the second proximal web.

7. The structural dovetail panel system of claim 4, wherein the second proximal top flange and the first distal top flange are restricted from moving horizontally with respect to each other by the second proximal arm and the first distal arm.

8. The structural dovetail panel system of claim 1, further comprising:

one or more dovetail anchors located within the sidelap cavity.

9. The structural dovetail panel system of claim 1, wherein the one or more couplings comprise fasteners that extend through the second proximal top flange and the first distal top flange.

10. The structural dovetail panel system of claim 1, further comprising:

a third structural dovetail panel comprising a plurality of third dovetail flutes, wherein each of the plurality of third dovetail flutes comprise a third top flange, portions of two third bottom flanges, and two third webs operatively coupling the third top flange to the portions of the two third bottom flanges, wherein the two third webs converge from the third top flange towards the portions of the two third bottom flanges to form a third flute cavity with a third flute opening; and wherein the two third bottom flanges of the third dovetail flutes comprise two third ribs;

wherein the two second bottom flanges of the second dovetail flutes comprise two second ribs;

wherein the two first bottom flanges of the first dovetail flutes comprise two first ribs; and wherein the third structural dovetail panel is in series with the first structural dovetail panel and the second structural dovetail panel and the plurality of third dovetail flutes are offset with the first dovetail flutes and the second dovetail flutes such that the two third ribs are offset with the two second ribs and the two third ribs.

11. A method of assembling a structural dovetail panel system, the method comprising:

assembling a first structural dovetail panel to one or more support members, wherein the first structural dovetail panel comprises:

a plurality of first dovetail flutes wherein each of the plurality of first dovetail flutes comprise a first top flange, portions of two first bottom flanges, and two first webs operatively coupling the first top flange to the portions of the two first bottom flanges, wherein the two first webs converge from the first top flange towards the portions of the two first bottom flanges to form a first flute cavity with a first flute opening; and a first distal edge comprising a first distal top flange;

assembling a second structural dovetail panel to the first structural dovetail panel and the one or more support members, wherein the second structural dovetail panel comprises:

a plurality of second dovetail flutes, wherein each of the plurality of second dovetail flutes comprise a second top flange, portions of two second bottom flanges, and two second webs operatively coupling the second top flange to the portions of the two second bottom flanges, wherein the two second webs converge from the second top flange towards the portions of the two second bottom flanges to form a second flute cavity with a second flute opening;

a second proximal edge comprising a second proximal top flange and a second proximal arm extending outwardly away from the second structural panel at an obtuse internal angle with the second proximal top flange; and wherein the second proximal top flange and the second proximal arm are located over the first distal top flange to create a dovetail sidelap and a sidelap cavity with a sidelap opening; and forming one or more couplings in the sidelap to operatively couple the first structural dovetail panel to the second structural dovetail panel.

12. The method of assembling the structural dovetail panel system of claim 11, wherein the second proximal top flange is operatively coupled to a second bottom flange through a second proximal web, and wherein the second proximal arm extends outwardly away from the second structural dovetail panel at a second proximal arm angle that is less than or equal to a second proximal web angle of the second proximal web with respect to a second proximal top flange plane.

13. The method of assembling the structural dovetail panel system of claim 11, wherein a first distal arm extends inwardly towards the first structural dovetail panel from the first distal edge, and wherein the second proximal top flange and the second proximal arm are located over the first distal top flange and the first distal arm.

14. The method of assembling the structural dovetail panel system of claim 13, wherein the second proximal top flange is operatively coupled to a second bottom flange through a second proximal web, and wherein the first distal arm extends inwardly toward the first structural dovetail panel at a first distal arm angle that is less than or equal to a second proximal web angle of the second proximal web with respect to a second proximal top flange plane.

15. The method of assembling the structural dovetail panel system of claim 13, wherein the second proximal top flange and the first distal top flange are restricted from moving horizontally with respect to each other by the second proximal arm and the first distal arm.

16. The method of assembling the structural dovetail panel system of claim 13, wherein assembling the second structural dovetail panel to the first structural dovetail panel comprises moving a second proximal edge of the second structural dovetail panel towards a first distal edge of the first structural dovetail panel at an angle to allow the second proximal top flange and the second proximal arm to be located over the first distal top flange and the first distal arm.

17. The method of assembling the structural dovetail panel system of claim 11, further comprising:

assembling one or more dovetail anchors within the sidelap cavity.

* * * * *